US009953659B2

(12) United States Patent
Baeckstroem et al.

(10) Patent No.: US 9,953,659 B2
(45) Date of Patent: Apr. 24, 2018

(54) APPARATUS AND METHOD FOR AUDIO SIGNAL ENVELOPE ENCODING, PROCESSING, AND DECODING BY MODELLING A CUMULATIVE SUM REPRESENTATION EMPLOYING DISTRIBUTION QUANTIZATION AND CODING

(71) Applicant: Fraunhofer-Gesellschaft zur Foerderung der angewandten Forschung e.V., Munich (DE)

(72) Inventors: Tom Baeckstroem, Nuremberg (DE); Benjamin Schubert, Nuremberg (DE); Markus Multrus, Nuremberg (DE); Sascha Disch, Fuerth (DE); Konstantin Schmidt, Nuremberg (DE); Grzegorz Pietrzyk, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/964,245

(22) Filed: Dec. 9, 2015

(65) Prior Publication Data

US 2016/0155451 A1 Jun. 2, 2016

Related U.S. Application Data

(63) Continuation of application No. PCT/EP2014/062034, filed on Jun. 10, 2014.

(30) Foreign Application Priority Data

Jun. 10, 2013 (EP) ..... 13171314
May 5, 2014 (EP) ..... 14167070

(51) Int. Cl.
*G10L 19/00* (2013.01)
*G10L 19/06* (2013.01)
(Continued)

(52) U.S. Cl.
CPC ..... *G10L 19/06* (2013.01); *G10L 19/0208* (2013.01); *G10L 19/032* (2013.01); *G10L 19/0204* (2013.01)

(58) Field of Classification Search
CPC ..... G10L 19/06; G10L 19/022; G10L 21/038
(Continued)

(56) References Cited

U.S. PATENT DOCUMENTS 5,710,863 A 1/1998 Chen
5,765,127 A 6/1998 Nishiguchi et al.
(Continued)

FOREIGN PATENT DOCUMENTS

EP 0764941 B1 5/2002
JP 1993-281995 A 10/1993
(Continued)

OTHER PUBLICATIONS

Office Action dated Feb. 20, 2017 issued in co-pending Russian application No. 2015156587, with English translation (10 pages).
(Continued)

*Primary Examiner* — Daniel Abebe
(74) *Attorney, Agent, or Firm* — Haynes and Boone, LLP; Robert P. Ziemian

(57) ABSTRACT

An apparatus for generating an audio signal envelope from one or more coding values is provided. The apparatus includes an input interface for receiving the one or more coding values, and an envelope generator for generating the audio signal envelope depending on the one or more coding values. The envelope generator is configured to generate an aggregation function depending on the one or more coding
(Continued)

values, wherein the aggregation function includes a plurality of aggregation points. Furthermore, the envelope generator is configured to generate the audio signal envelope such that the envelope value of each of the envelope points of the audio signal envelope depends on the aggregation value of at least one aggregation point of the aggregation function.

18 Claims, 17 Drawing Sheets

(51) Int. Cl.
*G10L 19/032* (2013.01)
*G10L 19/02* (2013.01)

(58) Field of Classification Search
USPC ..... 704/500
See application file for complete search history.

(56) References Cited

U.S. PATENT DOCUMENTS

| | | | |
|---|---|---|---|
| 5,960,388 | A | 9/1999 | Nishiguchi et al. |
| 5,983,172 | A | 11/1999 | Takashima et al. |
| 6,978,236 | B1 | 12/2005 | Liljeryd et al. |
| 7,328,162 | B2 | 2/2008 | Liljeryd et al. |
| 8,296,159 | B2 | 10/2012 | Neuendorf |
| 9,015,052 | B2 | 4/2015 | Lin et al. |
| 2008/0120116 | A1* | 5/2008 | Schnell ..... G10L 19/025 704/500 |
| 2009/0030678 | A1 | 1/2009 | Kovesi et al. |
| 2011/0202358 | A1* | 8/2011 | Neuendorf ..... G10L 19/0208 704/503 |
| 2016/0148621 | A1 | 5/2016 | Baeckstroem et al. |
| 2016/0155451 | A1 | 6/2016 | Baeckstroem et al. |

FOREIGN PATENT DOCUMENTS

| | | | |
|---|---|---|---|
| JP | 1997-153811 | A | 6/1997 |
| JP | 2016518979 | | 6/2016 |
| JP | 2016524186 | A | 8/2016 |
| KR | 1020080025403 | A | 3/2008 |
| RU | 2008/126699 | A1 | 2/2010 |
| RU | 2439721 | C2 | 1/2012 |
| WO | WO 2009/038136 | A1 | 3/2009 |
| WO | WO2010/003543 | A1 | 1/2010 |
| WO | WO2010/003546 | A2 | 1/2010 |
| WO | WO 2012/146757 | A1 | 11/2012 |

OTHER PUBLICATIONS

Herre et al.; "Enhancing the Performance of Perceptual Audio Coders by Using Temporal Noise Shaping (TNS)," Audio Engineering Society Convention 101; 1996.
International Search Report in related PCT Application No. PCT/EP2014/062032 dated Aug. 18, 2014 (4 pages).
Kuntz et al.; "The Transient Steering Decorrelator Tool in the upcoming MPEG Unified Speech and Audio Coding Standard," 131st Convention of Audio Engineering Society, Oct. 20-23, 2011; pp. 1-9; New York, New York.
Makhoul, John; "Linear Prediction: A Tutorial Review," Proceedings of the IEEE, Apr. 1975; 63(4):561-580.
Neuendorf et al.; "Unified Speech and Audio Coding Scheme for High Quality at Low Bitrates," IEEE International Conference on Acoustics, Speech and Signal Processing, Apr. 2009; pp. 1-4.
Pan, Davis; "A Tutorial on MPEG/Audio Compression," IEEE Multimedia 2.2, 1995; pp. 60-74.
Soong et al.; "Line Spectrum Pair (LSP) and Speech Data Compression," IEEE International Conference on Acoustics, Speech and Signal Processing, Mar. 19-21, 1984; pp. 1.10.1-1.10.4; San Diego, California.
xiph.org Foundation; "Vorbis I specification, Feb. 3, 2012"; retrieved from the Internet: URL: http://www.xiph.org/vorbis/doc/Vorbis_I_spec.pdf.
Feb. 21, 2017 Japanese Office Action issued as to Pat. App. No. 2016-518977 (translated).
Feb. 21, 2017 Japanese Office Action issued as to Pat. App. No. 2016-518979 (translated).
Office Action dated Mar. 30, 2017 issued in co-pending U.S. Appl. No. 14/964,234 (13 pages).
Office Action dated Apr. 13, 2017 issued in co-pending Russian Patent App. No. 2015156490, including English translatin (10 pages).
Marina Bosi, et al. ISO/IEC MPEG-2 advanced audio coding. Journal of the Audio engineering society, 1997, vol. 45. No. 10, pp. 789-814 (26 pages).
Jim Valin, Definition of the Opus Audio Codec. Internet Engineering Task Force (IETF) RFC 6716, Sep. 2012 (326 pages).
Notice of Decision to Grant Patent issued in co-pending Korean App. No. 10-2015-7037061 dated Jul. 25, 2017 (5 pages including English translation).

* cited by examiner

```
s =bsSpCodedPos;
p =bsSpNumTrSlots+1;
N =numSlots

for (k=0; k<N; k++)
{
    spSepData[k]=0;
}

for (k=N-1; k>=0; k--)
{
    if (p > k) {
        for (;k>=0; k--)
            spSepData[k]=1;
        break;
    }
    c = k-p+1;
    for (h=2; h<=p; h++) {
        c *= k - p + h;
        c /= h;
    }
    if (s >= (int)c) { /* c is long long for up to 32 slots */
        s -= c;
        spSepData[k]=1;
        p--;
        if (p == 0)
            break;
        }
}
```

FIG. 10

```
p_s = 0;
for (k=spPosLen-1; k>=0; k--){
    pos = spPos[k];
    if (k >= pos) {
        break;
    }
    c = 1; /* c is long long for up to 32 pos*/
    for (h=1; h<=(k+1); h++) {
        c *= pos-k-1 + h;
        c /= h;
    }
    p_s += c;
}
bsSpCodedPos = p_s;
```

APPARATUS AND METHOD FOR AUDIO SIGNAL ENVELOPE ENCODING, PROCESSING, AND DECODING BY MODELLING A CUMULATIVE SUM REPRESENTATION EMPLOYING DISTRIBUTION QUANTIZATION AND CODING

CROSS-REFERENCE TO RELATED APPLICATIONS

This application is a continuation of copending International Application No. PCT/EP2014/062034, filed Jun. 10, 2014, which is incorporated herein by reference in its entirety, and additionally claims priority from European Applications Nos. EP 13171314.1, filed Jun. 6, 2013, and EP 14167070.3, filed May 5, 2014, which are all incorporated herein by reference in their entirety.

BACKGROUND OF THE INVENTION

The present invention relates to an apparatus and method for audio signal envelope encoding, processing and decoding and, in particular, to an apparatus and method for audio signal envelope encoding, processing and decoding employing distribution quantization and coding.

Linear predictive coding (LPC) is a classic tool for modeling the spectral envelope of the core bandwidth in speech codecs. The most common domain for quantizing LPC models is the line spectrum frequency (LSF) domain. It is based on a decomposition of the LPC polynomial into two polynomials, whose roots are on the unit circle, such that they can be described by their angles or frequencies only.

SUMMARY

According to an embodiment, an apparatus for generating an audio signal envelope from one or more coding values may have: an input interface for receiving the one or more coding values, and an envelope generator for generating the audio signal envelope depending on the one or more coding values, wherein the envelope generator is configured to generate an aggregation function depending on the one or more coding values, wherein the aggregation function includes a plurality of aggregation points, wherein each of the aggregation points includes an argument value and an aggregation value, wherein the aggregation function monotonically increases, and wherein each of the one or more coding values indicates at least one of the argument value and the aggregation value of one of the aggregation points of the aggregation function, wherein the envelope generator is configured to generate the audio signal envelope such that the audio signal envelope includes a plurality of envelope points, wherein each of the envelope points includes an argument value and an envelope value, and wherein, for each of the aggregation points of the aggregation function, one of the envelope points of the audio signal envelope is assigned to said aggregation point such that the argument value of said envelope point is equal to the argument value of said aggregation point, and wherein the envelope generator is configured to generate the audio signal envelope such that the envelope value of each of the envelope points of the audio signal envelope depends on the aggregation value of at least one aggregation point of the aggregation function.

According to another embodiment, an apparatus for determining one or more coding values for encoding an audio signal envelope may have: an aggregator for determining an aggregated value for each of a plurality of argument values, wherein the plurality of argument values are ordered such that a first argument value of the plurality of argument values either precedes or succeeds a second argument value of the plurality of argument values, when said second argument value is different from the first argument value, wherein an envelope value is assigned to each of the argument values, wherein the envelope value of each of the argument values depends on the audio signal envelope, and wherein the aggregator is configured to determine the aggregated value for each argument value of the plurality of argument values depending on the envelope value of said argument value, and depending on the envelope value of each of the plurality of argument values which precede said argument value, and an encoding unit for determining one or more coding values depending on one or more of the aggregated values of the plurality of argument values.

According to another embodiment, a method for generating an audio signal envelope from one or more coding values may have the steps of: receiving the one or more coding values, and generating the audio signal envelope depending on the one or more coding values, wherein generating the audio signal envelope is conducted by generating an aggregation function depending on the one or more coding values, wherein the aggregation function includes a plurality of aggregation points, wherein each of the aggregation points includes an argument value and an aggregation value, wherein the aggregation function monotonically increases, and wherein each of the one or more coding values indicates at least one of the argument value and the aggregation value of one of the aggregation points of the aggregation function, wherein generating the audio signal envelope is conducted such that the audio signal envelope includes a plurality of envelope points, wherein each of the envelope points includes an argument value and an envelope value, and wherein, for each of the aggregation points of the aggregation function, one of the envelope points of the audio signal envelope is assigned to said aggregation point such that the argument value of said envelope point is equal to the argument value of said aggregation point, and wherein generating the audio signal envelope is conducted such that the envelope value of each of the envelope points of the audio signal envelope depends on the aggregation value of at least one aggregation point of the aggregation function.

According to another embodiment, a method for determining one or more coding values for encoding an audio signal envelope may have the steps of: determining an aggregated value for each of a plurality of argument values, wherein the plurality of argument values are ordered such that a first argument value of the plurality of argument values either precedes or succeeds a second argument value of the plurality of argument values, when said second argument value is different from the first argument value, wherein an envelope value is assigned to each of the argument values, wherein the envelope value of each of the argument values depends on the audio signal envelope, and wherein the aggregator is configured to determine the aggregated value for each argument value of the plurality of argument values depending on the envelope value of said argument value, and depending on the envelope value of each of the plurality of argument values which precede said argument value, and determining one or more coding values depending on one or more of the aggregated values of the plurality of argument values.

Another embodiment may have a computer program for implementing the inventive methods when being executed on a computer or signal processor.

An apparatus for generating an audio signal envelope from one or more coding values is provided. The apparatus comprises an input interface for receiving the one or more coding values, and an envelope generator for generating the audio signal envelope depending on the one or more coding values. The envelope generator is configured to generate an aggregation function depending on the one or more coding values, wherein the aggregation function comprises a plurality of aggregation points, wherein each of the aggregation points comprises an argument value and an aggregation value, wherein the aggregation function monotonically increases, and wherein each of the one or more coding values indicates at least one of an argument value and an aggregation value of one of the aggregation points of the aggregation function. Moreover, the envelope generator is configured to generate the audio signal envelope such that the audio signal envelope comprises a plurality of envelope points, wherein each of the envelope points comprises an argument value and an envelope value, and wherein an envelope point of the audio signal envelope is assigned to each of the aggregation points of the aggregation function such that the argument value of said envelope point is equal to the argument value of said aggregation point. Furthermore, the envelope generator is configured to generate the audio signal envelope such that the envelope value of each of the envelope points of the audio signal envelope depends on the aggregation value of at least one aggregation point of the aggregation function.

According to an embodiment, the envelope generator may, e.g., be configured to determine the aggregation function by determining one of the aggregation points for each of the one or more coding values depending on said coding value, and by applying interpolation to obtain the aggregation function depending on the aggregation point of each of the one or more coding values.

In an embodiment, the envelope generator may, e.g., be configured to determine a first derivate of the aggregation function at a plurality of the aggregation points of the aggregation function.

According to an embodiment, the envelope generator may, e.g., be configured to generate the aggregation function depending on the coding values so that the aggregation function has a continuous first derivative.

In an embodiment, the envelope generator may, e.g., be configured to determine the audio signal envelope by applying $$tilt(k) = \frac{c(k+1) - c(k-1)}{f(k+1) - f(k-1)}$$

wherein tilt(k) indicates the derivative of the aggregated signal envelope at the k-th coding value, wherein c(k) is the aggregated value of the k-th aggregated point of the aggregation function, and wherein $f$(k) is the argument value of the k-th aggregated point of the aggregation function.

According to an embodiment, the input interface may be configured to receive one or more splitting values as the one or more coding values. The envelope generator may be configured to generate the aggregation function depending on the one or more splitting values, wherein each of the one or more splitting values indicates the aggregation value of one of the aggregation points of the aggregation function. Moreover, the envelope generator may be configured to generate the reconstructed audio signal envelope such that the one or more splitting points divide the reconstructed audio signal envelope into two or more audio signal envelope portions, wherein a predefined assignment rule defines a signal envelope portion value for each signal envelope portion of the two or more signal envelope portions depending on said signal envelope portion. Furthermore, the envelope generator may be configured to generate the reconstructed audio signal envelope such that, for each of the two or more signal envelope portions, an absolute value of its signal envelope portion value is greater than half of an absolute value of the signal envelope portion value of each of the other signal envelope portions.

Moreover, an apparatus for determining one or more coding values for encoding an audio signal envelope is provided. The apparatus comprises an aggregator for determining an aggregated value for each of a plurality of argument values, wherein the plurality of argument values are ordered such that a first argument value of the plurality of argument values either precedes or succeeds a second argument value of the plurality of argument values, when said second argument value is different from the first argument value, wherein an envelope value is assigned to each of the argument values, wherein the envelope value of each of the argument values depends on the audio signal envelope, and wherein the aggregator is configured to determine the aggregated value for each argument value of the plurality of argument values depending on the envelope value of said argument value, and depending on the envelope value of each of the plurality of argument values which precede said argument value. Furthermore, the apparatus comprises an encoding unit for determining one or more coding values depending on one or more of the aggregated values of the plurality of argument values.

According to an embodiment, the aggregator may, e.g., be configured to determine the aggregated value for each argument value of the plurality of argument values by adding the envelope value of said argument value and the envelope values of the argument values which precede said argument value.

In an embodiment, the envelope value of each of the argument values may, e.g., indicate an energy value of an audio signal envelope having the audio signal envelope as signal envelope.

According to an embodiment, the envelope value of each of the argument values may, e.g., indicate an n-th power of a spectral value of an audio signal envelope having the audio signal envelope as signal envelope, wherein n is an even integer greater zero.

In an embodiment, the envelope value of each of the argument values may, e.g., indicate an n-th power of an amplitude value of an audio signal envelope, being represented in a time domain, and having the audio signal envelope as signal envelope, wherein n is an even integer greater zero.

According to an embodiment, the encoding unit may, e.g., be configured to determine the one or more coding values depending on one or more of the aggregated values of the argument values, and depending on a coding values number, which indicates how many values are to be determined by the encoding unit as the one or more coding values.

In an embodiment, the coding unit may, e.g., be configured to determine the one or more coding values according to $$c(k) - \min_j \left( \left| a(j) - k \frac{\max(a)}{N} \right| \right),$$

wherein c(k) indicates the k-th coding value to be determined by the coding unit, wherein j indicates the j-th argument value of the plurality of argument values, wherein a(j) indicates the aggregated value being assigned to the j-th argument value, wherein max(a) indicates a maximum value being one of the aggregated values which are assigned to one of the argument values, wherein none of the aggregated values which are assigned to one of the argument values is greater than the maximum value, and
wherein $$\min_j \left( \left| a(j) - k \frac{\max(a)}{N} \right| \right)$$

indicates a minimum value being one of the argument values for which $$\left| a(j) - k \frac{\max(a)}{N} \right|$$

is minimal.

Moreover, a method for generating an audio signal envelope from one or more coding values is provided. The method comprises Receiving the one or more coding values; and Generating the audio signal envelope depending on the one or more coding values.

Generating the audio signal envelope is conducted by generating an aggregation function depending on the one or more coding values, wherein the aggregation function comprises a plurality of aggregation points, wherein each of the aggregation points comprises an argument value and an aggregation value, wherein the aggregation function monotonically increases, and wherein each of the one or more coding values indicates at least one of an argument value and an aggregation value of one of the aggregation points of the aggregation function. Moreover, generating the audio signal envelope is conducted such that the audio signal envelope comprises a plurality of envelope points, wherein each of the envelope points comprises an argument value and an envelope value, and wherein an envelope point of the audio signal envelope is assigned to each of the aggregation points of the aggregation function such that the argument value of said envelope point is equal to the argument value of said aggregation point. Furthermore, generating the audio signal envelope is conducted such that the envelope value of each of the envelope points of the audio signal envelope depends on the aggregation value of at least one aggregation point of the aggregation function.

Furthermore, a method for determining one or more coding values for encoding an audio signal envelope is provided. The method comprises:

Determining an aggregated value for each of a plurality of argument values, wherein the plurality of argument values are ordered such that a first argument value of the plurality of argument values either precedes or succeeds a second argument value of the plurality of argument values, when said second argument value is different from the first argument value, wherein an envelope value is assigned to each of the argument values, wherein the envelope value of each of the argument values depends on the audio signal envelope, and wherein the aggregator is configured to determine the aggregated value for each argument value of the plurality of argument values depending on the envelope value of said argument value, and depending on the envelope value of each of the plurality of argument values which precede said argument value; and Determining one or more coding values depending on one or more of the aggregated values of the plurality of argument values.

Furthermore, a computer program for implementing one of the above-described methods when being executed on a computer or signal processor is provided.

An apparatus for decoding to obtain a reconstructed audio signal envelope is provided. The apparatus comprises a signal envelope reconstructor for generating the reconstructed audio signal envelope depending on one or more splitting points, and an output interface for outputting the reconstructed audio signal envelope. The signal envelope reconstructor is configured to generate the reconstructed audio signal envelope such that the one or more splitting points divide the reconstructed audio signal envelope into two or more audio signal envelope portions, wherein a predefined assignment rule defines a signal envelope portion value for each signal envelope portion of the two or more signal envelope portions depending on said signal envelope portion. Moreover, the signal envelope reconstructor is configured to generate the reconstructed audio signal envelope such that, for each of the two or more signal envelope portions, an absolute value of its signal envelope portion value is greater than half of an absolute value of the signal envelope portion value of each of the other signal envelope portions.

According to an embodiment, the signal envelope reconstructor may, e.g., be configured to generate the reconstructed audio signal envelope such that, for each of the two or more signal envelope portions, the absolute value of its signal envelope portion value is greater than 90% of the absolute value of the signal envelope portion value of each of the other signal envelope portions.

In an embodiment, the signal envelope reconstructor may, e.g., be configured to generate the reconstructed audio signal envelope such that, for each of the two or more signal envelope portions, the absolute value of its signal envelope portion value is greater than 99% of the absolute value of the signal envelope portion value of each of the other signal envelope portions.

In another embodiment, the signal envelope reconstructor 110 may, e.g., be configured to generate the reconstructed audio signal envelope such that the signal envelope portion value of each of the two or more signal envelope portions is equal to the signal envelope portion value of each of the other signal envelope portions of the two or more signal envelope portions.

According to an embodiment, the signal envelope portion value of each signal envelope portion of the two or more signal envelope portions may, e.g., depend on one or more energy values or one or more power values of said signal envelope portion. Or the signal envelope portion value of each signal envelope portion of the two or more signal envelope portions depends on any other value suitable for reconstructing an original or a targeted level of the audio signal envelope.

The scaling of the envelope may be implemented in various ways. Specifically, it can correspond to signal energy or spectral mass or similar (an absolute size), or it can be a scaling or gain factor (a relative size). Accordingly, it can be encoded as an absolute or relative value, or it can be encoded by a difference to a previous value or to a combination of previous values. In some cases the scaling can also be irrelevant or deduced from other available data. The envelope shall be reconstructed to its original or a targeted level. So in general, the signal envelope portion value depends on any value suitable for reconstructing the original or targeted level of the audio signal envelope.

In an embodiment, the apparatus may, e.g., further comprise a splitting points decoder for decoding one or more encoded points according to a decoding rule to obtain a position of each of the one or more splitting points. The splitting points decoder may, e.g., be configured to analyse a total positions number indicating a total number of possible splitting point positions, a splitting points number indicating the number of the one or more splitting points, and a splitting points state number. Moreover, the splitting points decoder may, e.g., be configured to generate an indication of the position of each of the one or more splitting points using the total positions number, the splitting points number and the splitting points state number.

According to an embodiment, the signal envelope reconstructor may, e.g., be configured to generate the reconstructed audio signal envelope depending on a total energy value indicating a total energy of the reconstructed audio signal envelope, or depending on any other value suitable for reconstructing an original or a targeted level of the audio signal envelope.

Furthermore, an apparatus for decoding to obtain a reconstructed audio signal envelope according to another embodiment is provided. The apparatus comprises a signal envelope reconstructor for generating the reconstructed audio signal envelope depending on one or more splitting points, and an output interface for outputting the reconstructed audio signal envelope. The signal envelope reconstructor is configured to generate the reconstructed audio signal envelope such that the one or more splitting points divide the reconstructed audio signal envelope into two or more audio signal envelope portions, wherein a predefined assignment rule defines a signal envelope portion value for each signal envelope portion of the two or more signal envelope portions depending on said signal envelope portion. A predefined envelope portion value is assigned to each of the two or more signal envelope portions. The signal envelope reconstructor is configured to generate the reconstructed audio signal envelope such that, for each signal envelope portion of the two or more signal envelope portions, an absolute value of the signal envelope portion value of said signal envelope portion is greater than 90% of an absolute value of the predefined envelope portion value being assigned to said signal envelope portion, and such that the absolute value of the signal envelope portion value of said signal envelope portion is smaller than 110% of the absolute value of the predefined envelope portion value being assigned to said signal envelope portion.

In an embodiment, the signal envelope reconstructor is configured to generate the reconstructed audio signal envelope such that the signal envelope portion value of each of the two or more signal envelope portions is equal to the predefined envelope portion value being assigned to said signal envelope portion.

In an embodiment, the predefined envelope portion values of two or more of the signal envelope portions differ from each other.

In another embodiment, the predefined envelope portion value of each of the signal envelope portions differs from the predefined envelope portion value of each of the other signal envelope portions.

Moreover, an apparatus for reconstructing an audio signal is provided. The apparatus comprises an apparatus for decoding according to one of the above-described embodiments to obtain a reconstructed audio signal envelope of the audio signal, and signal generator for generating the audio signal depending on the audio signal envelope of the audio signal and depending on a further signal characteristic of the audio signal, the further signal characteristic being different from the audio signal envelope.

Furthermore, an apparatus for encoding an audio signal envelope is provided. The apparatus comprises an audio signal envelope interface for receiving the audio signal envelope, and a splitting point determiner for determining, depending on a predefined assignment rule, a signal envelope portion value for at least one audio signal envelope portion of two or more audio signal envelope portions for each of two or more splitting point configurations. Each of the two or more splitting point configurations comprises one or more splitting points, wherein the one or more splitting points of each of the two or more splitting point configurations divide the audio signal envelope into the two or more audio signal envelope portions. The splitting point determiner is configured to select the one or more splitting points of one of the two or more splitting point configurations as one or more selected splitting points to encode the audio signal envelope, wherein the splitting point determiner is configured to select the one or more splitting points depending on the signal envelope portion value of each of the at least one audio signal envelope portion of the two or more audio signal envelope portions of each of the two or more splitting point configurations.

According to an embodiment, the signal envelope portion value of each signal envelope portion of the two or more signal envelope portions may, e.g., depend on one or more energy values or one or more power values of said signal envelope portion. Or the signal envelope portion value of each signal envelope portion of the two or more signal envelope portions depends on any other value suitable for reconstructing an original or a targeted level of the audio signal envelope.

As already mentioned the scaling of the envelope may be implemented in various ways. Specifically, it can correspond to signal energy or spectral mass or similar (an absolute size), or it can be a scaling or gain factor (a relative size). Accordingly, it can be encoded as an absolute or relative value, or it can be encoded by a difference to a previous value or to a combination of previous values. In some cases the scaling can also be irrelevant or deduced from other available data. The envelope shall be reconstructed to its original or a targeted level. So in general, the signal envelope portion value depends on any value suitable for reconstructing the original or targeted level of the audio signal envelope.

In an embodiment, the apparatus may, e.g., further comprise a splitting points encoder for encoding a position of each of the one or more splitting points to obtain one or more encoded points. The splitting points encoder may, e.g., be configured to encode a position of each of the one or more splitting points by encoding a splitting points state number. Moreover, the splitting points encoder may, e.g., be configured to provide a total positions number indicating a total number of possible splitting point positions, and a splitting points number indicating the number of the one or more splitting points. The splitting points state number, the total positions number and the splitting points number together indicate the position of each of the one or more splitting points.

According to an embodiment, the apparatus may, e.g., further comprise an energy determiner for determining a total energy of the audio signal envelope and for encoding the total energy of the audio signal envelope. Or, the apparatus may, e.g., be furthermore configured to determine any other value suitable for reconstructing an original or a targeted level of the audio signal envelope.

Moreover, an apparatus for encoding an audio signal is provided. The apparatus comprises an apparatus for encoding according to one of the above-described embodiments for encoding an audio signal envelope of the audio signal, and a secondary signal characteristic encoder for encoding a further signal characteristic of the audio signal, the further signal characteristic being different from the audio signal envelope.

Furthermore, a method for decoding to obtain a reconstructed audio signal envelope is provided. The method comprises:

Generating the reconstructed audio signal envelope depending on one or more splitting points; and Outputting the reconstructed audio signal envelope.

Generating the reconstructed audio signal envelope is conducted such that the one or more splitting points divide the reconstructed audio signal envelope into two or more audio signal envelope portions, wherein a predefined assignment rule defines a signal envelope portion value for each signal envelope portion of the two or more signal envelope portions depending on said signal envelope portion. Moreover, generating the reconstructed audio signal envelope is conducted such that, for each of the two or more signal envelope portions, an absolute value of its signal envelope portion value is greater than half of an absolute value of the signal envelope portion value of each of the other signal envelope portions.

Furthermore, a method for decoding to obtain a reconstructed audio signal envelope is provided. The method comprises:

Generating the reconstructed audio signal envelope depending on one or more splitting points; and Outputting the reconstructed audio signal envelope.

Generating the reconstructed audio signal envelope is conducted such that the one or more splitting points divide the reconstructed audio signal envelope into two or more audio signal envelope portions, wherein a predefined assignment rule defines a signal envelope portion value for each signal envelope portion of the two or more signal envelope portions depending on said signal envelope portion. A predefined envelope portion value is assigned to each of the two or more signal envelope portions. Moreover, generating the reconstructed audio signal envelope is conducted such that, for each signal envelope portion of the two or more signal envelope portions, an absolute value of the signal envelope portion value of said signal envelope portion is greater than 90% of an absolute value of the predefined envelope portion value being assigned to said signal envelope portion, and such that the absolute value of the signal envelope portion value of said signal envelope portion is smaller than 110% of the absolute value of the predefined envelope portion value being assigned to said signal envelope portion.

Moreover, a method for encoding an audio signal envelope is provided. The method comprises:

Receiving the audio signal envelope;

Determining, depending on a predefined assignment rule, a signal envelope portion value for at least one audio signal envelope portion of two or more audio signal envelope portions for each of two or more splitting point configurations, wherein each of the two or more splitting point configurations comprises one or more splitting points, wherein the one or more splitting points of each of the two or more splitting point configurations divide the audio signal envelope into the two or more audio signal envelope portions; and Selecting the one or more splitting points of one of the two or more splitting point configurations as one or more selected splitting points to encode the audio signal envelope, wherein selecting the one or more splitting points is conducted depending on the signal envelope portion value of each of the at least one audio signal envelope portion of the two or more audio signal envelope portions of each of the two or more splitting point configurations.

Furthermore, a computer program for implementing one of the above-described methods when being executed on a computer or signal processor is provided.

A heuristic but a bit inaccurate description of the line spectrum frequency 5 (LSF5) is that they describe the distribution of signal energy along the frequency axis. With a high probability, the LSF5 will reside at frequencies where the signal has a lot of energy. Embodiments are based on the finding to take this heuristic description literarily and quantize the actual distribution of signal energy. Since the LSFs apply this idea only approximately, according to embodiments, the LSF concept is omitted and the distribution of frequencies is quantized instead, in such a way that a smooth envelope shape can be constructed from that distribution. This inventive concept is in the following referred to as distribution quantization.

Embodiments are based on quantizing and coding spectral envelopes to be used in speech and audio coding. Embodiments may, e.g., be applied in both the envelopes of the core-bandwidth as well as bandwidth extension methods.

According to embodiments, standard envelope modeling techniques, such as, scale-factor bands (see Pan, Davis. "A tutorial on MPEG/Audio compression." *Multimedia, IEEE* 2.2 (1995): 60-74; and M. Neuendorf, P. Gournay, M. Multrus, J. Lecomte, B. Bessette, R. Geiger, S. Bayer, G. Fuchs, J. Hilpert, N. Rettelbach, R. Salami, G. Schuller, R. Lefebvre, B. Grill. "Unified speech and audio coding scheme for high quality at low bitrates". In *Acoustics, Speech and Signal Processing,* 2009. ICASSP 2009. IEEE International Conference on (pp. 1-4). IEEE. April, 2009) and linear predictive models (see Makhoul, John. "Linear prediction: A tutorial review." *Proceedings of the IEEE* 63.4 (1975):561-580) may, for example, be replaced and/or improved.

An object of embodiments is to obtain a quantization, which combines the benefits of both, linear predictive approaches and scale-factor band based approaches, while omitting their drawbacks.

According to embodiments, concepts are provided, which have a smooth but rather precise spectral envelope on the one hand, but on the other hand may be coded with a low amount of bits (optionally with a fixed bit-rate) and furthermore realized with a reasonable computational complexity.

BRIEF DESCRIPTION OF THE DRAWINGS

Embodiments of the present invention will be detailed subsequently referring to the appended drawings, in which:

FIG. 10 illustrates a pseudo code implementing the decoding of splitting point positions according to an embodiment;

DETAILED DESCRIPTION OF THE INVENTION

Figure 3:
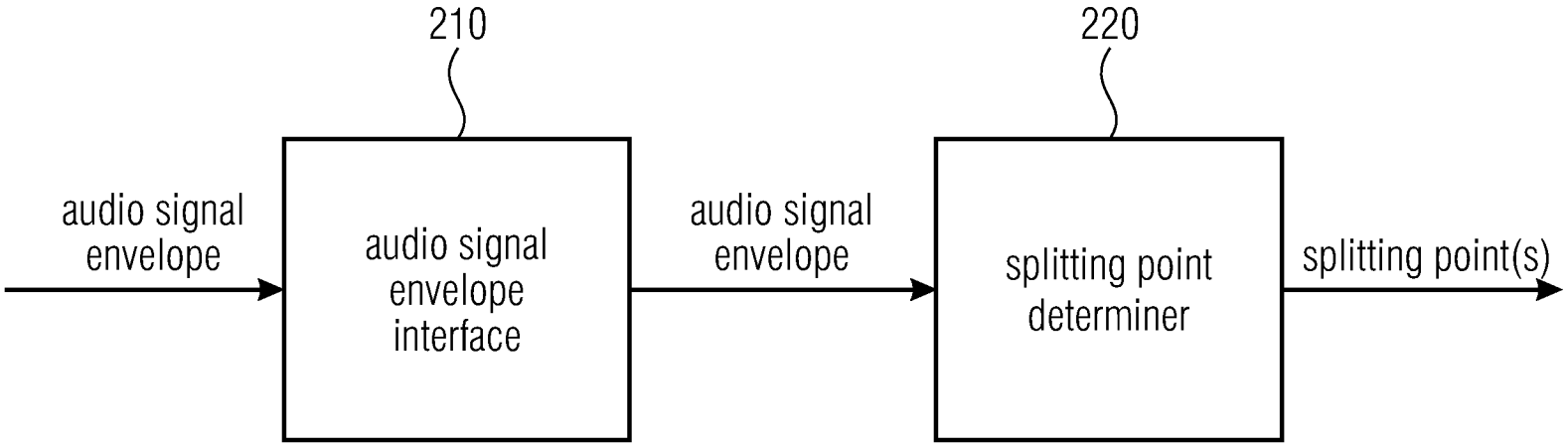
FIG. 3 illustrates an apparatus for encoding an audio signal envelope according to an embodiment.

FIG. 3 illustrates an apparatus for encoding an audio signal envelope according to an embodiment.

The apparatus comprises an audio signal envelope interface 210 for receiving the audio signal envelope.

Moreover, the apparatus comprises a splitting point determiner 220 for determining, depending on a predefined assignment rule, a signal envelope portion value for at least one audio signal envelope portion of two or more audio signal envelope portions for each of two or more splitting point configurations.

Each of the two or more splitting point configurations comprises one or more splitting points, wherein the one or more splitting points of each of the two or more splitting point configurations divide the audio signal envelope into the two or more audio signal envelope portions. The splitting point determiner 220 is configured to select the one or more splitting points of one of the two or more splitting point configurations as one or more selected splitting points to encode the audio signal envelope, wherein the splitting point determiner 220 is configured to select the one or more splitting points depending on the signal envelope portion value of each of the at least one audio signal envelope portion of the two or more audio signal envelope portions of each of the two or more splitting point configurations.

A splitting point configuration comprises one or more splitting points and is defined by its splitting points. For example, an audio signal envelope may comprise 20 samples, 0, . . . , 19 and a configuration with two splitting points may be defined by its first splitting point at the location of sample 3, and by its second splitting point at the location of sample 8, e.g. the splitting point configuration may be indicated by the tuple (3; 8). If only one splitting point shall be determined then a single splitting point indicates the splitting point configuration.

Suitable one or more splitting points shall be determined as one or more selected splitting points. For this purpose, two or more splitting point configurations each comprising one or more splitting points are considered. The one or more splitting points of the most suitable splitting point configuration are selected. Whether a splitting point configuration is more suitable than another one is determined depending on the determined signal envelope portion value which itself depends on the predefined assignment rule.

In embodiments, wherein each splitting point configurations has N splitting points, every possible splitting point configuration with splitting points may be considered. However, in some embodiments, not all possible, but only two splitting point configurations are considered and the splitting point of the most suitable splitting point configuration are chosen as the one or more selected splitting points.

In embodiments where only a single splitting point shall be determined, each splitting point configuration only comprises a single splitting point. In embodiments where two splitting points shall be determined, each splitting point configuration comprises two splitting points. Likewise, in embodiments, where N splitting points shall be determined, each splitting point configuration comprises N splitting points.

A splitting point configuration with a single splitting point divides the audio signal envelope into two audio signal envelope portions. A splitting point configuration with two splitting points divides the audio signal envelope into three audio signal envelope portions. A splitting point configuration with N splitting points divides the audio signal envelope into N+1 audio signal envelope portions.

A predefined assignment rule exists, which assigns a signal envelope portion value to each of the audio signal envelope portions. The predefined assignment rule depends on the audio signal envelope portions.

In some embodiments, splitting points are determined such that each of the audio signal envelope portions that result from the one or more splitting points dividing the audio signal envelope has a signal envelope portions value assigned by the predefined assignment rule that is roughly equal. Thus, as the one or more splitting points depend on the audio signal envelope and the assignment rule, the audio signal envelope can be estimated at a decoder, if the assignment rule and the splitting points are known at the decoder. This is for example, illustrated by FIGS. 6A-6C.

Figure 6A:
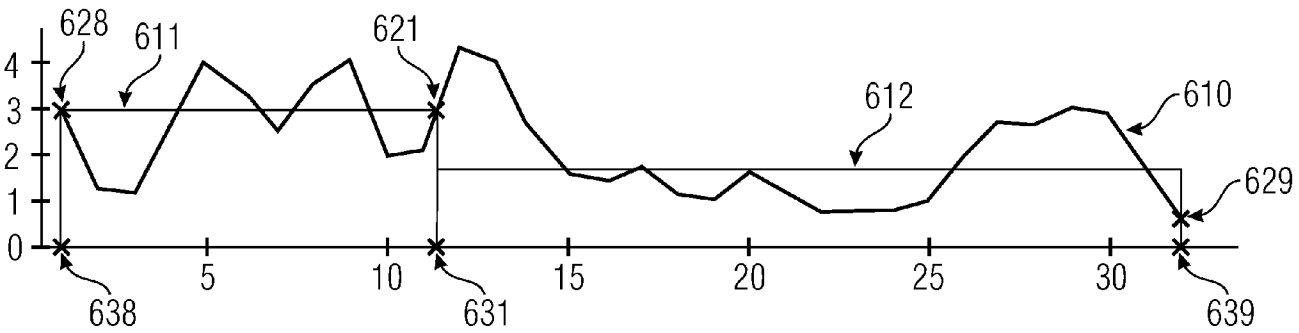
FIGS. 6A-6C illustrate three signal envelopes being described by constant energy blocks according to embodiments.

In FIG. 6A, a single splitting point for a signal envelope 610 shall be determined. Thus, in this example, the different possible splitting point configurations are defined by a single splitting point. In the embodiment of FIG. 6A, splitting point 631 is found as best splitting point. Splitting point 631 divides the audio signal envelope 610 into two signal envelope portions. Rectangle block 611 represents an energy of a first signal envelope portion defined by splitting point 631. Rectangle block 612 represents an energy of a second signal envelope portion defined by splitting point 631. In the example of FIG. 6A, the upper edges of blocks 611 and 612 represent an estimation of the signal envelope 610. Such an estimation can be made at a decoder, for example, using as information the splitting point 631 (e.g., if the only splitting point has the value s=12, then the splitting point s is located at position 12), information about where the signal envelope begins (here at point 638) and information where the signal envelope ends (here at point 639). The signal envelope may start and may end at fixed values and this information may be available as fixed information at the receiver. Or, this information may be transmitted to the receiver. On the decoder side, the decoder may reconstruct an estimation of the signal envelope such that the signal envelope portions, that result from the splitting point 631 splitting the audio signal envelope, get the same value assigned from the predefined assignment rule. In FIG. 6A, the signal envelope portions of a signal envelope being defined by the upper edges of the blocks 611 and 612 get the same value assigned by the assignment rule and represent a good estimation of the signal envelope 610. Instead of using splitting point 631, value 621 may also be used as splitting point. Moreover, instead of start value 638, value 628 may be used as start value and instead of end value 639, end value 629 may be used as end value. However, not only encoding the abscissa value, but also the ordinate value necessitates more coding resources and is not necessitated.

Figure 6B:
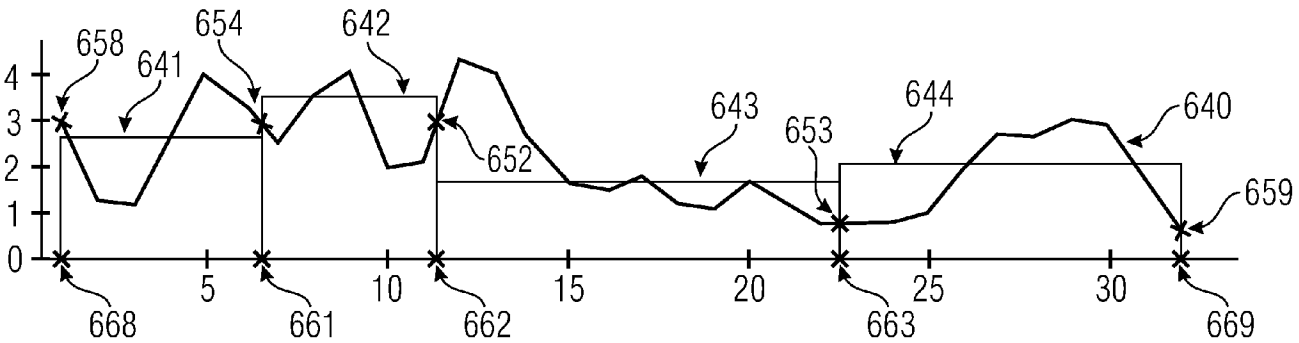

In FIG. 6B, three splitting points for a signal envelope 640 shall be determined. Thus, in this example, the different possible splitting point configurations are defined by three splitting points. In the embodiment of FIG. 6B, splitting points 661, 662, 663 are found as best splitting points. Splitting points 661, 662, 663 divide the audio signal envelope 640 into four signal envelope portions. Rectangle block 641 represents an energy of a first signal envelope portion defined by the splitting points. Rectangle block 642 represents an energy of a second signal envelope portion defined by the splitting points. Rectangle block 643 represents an energy of a third signal envelope portion defined by the splitting points. And rectangle block 644 represents an energy of a fourth signal envelope portion defined by the splitting points. In the example of FIG. 6B, the upper edges of blocks 641, 642, 643, 644 represent an estimation of the signal envelope 640. Such an estimation can be made at a decoder, for example, using as information the splitting points 661, 662, 663, information about where the signal envelope begins (here at point 668) and information where the signal envelope ends (here at point 669). The signal envelope may start and may end at fixed values and this information may be available as fixed information at the receiver. Or, this information may be transmitted to the receiver. On the decoder side, the decoder may reconstruct an estimation of the signal envelope such that the signal envelope portions, that result from the splitting points 661, 662, 663 splitting the audio signal envelope, get the same value assigned from the predefined assignment rule. In FIG. 6B, the signal envelope portions of a signal envelope being defined by the upper edges of the blocks 641, 642, 643, 644 gets the same value assigned by the assignment rule and represents a good estimation of the signal envelope 640. Instead of using splitting point 661, 662, 663, values 651, 652, 653 may also be used as splitting points. Moreover, instead of start value 668, value 658 may be used as start value and instead of end value 669, end value 659 may be used as end value. However, not only encoding the abscissa value, but also the ordinate value, necessitates more coding resources and is not necessitated.

Figure 6C:
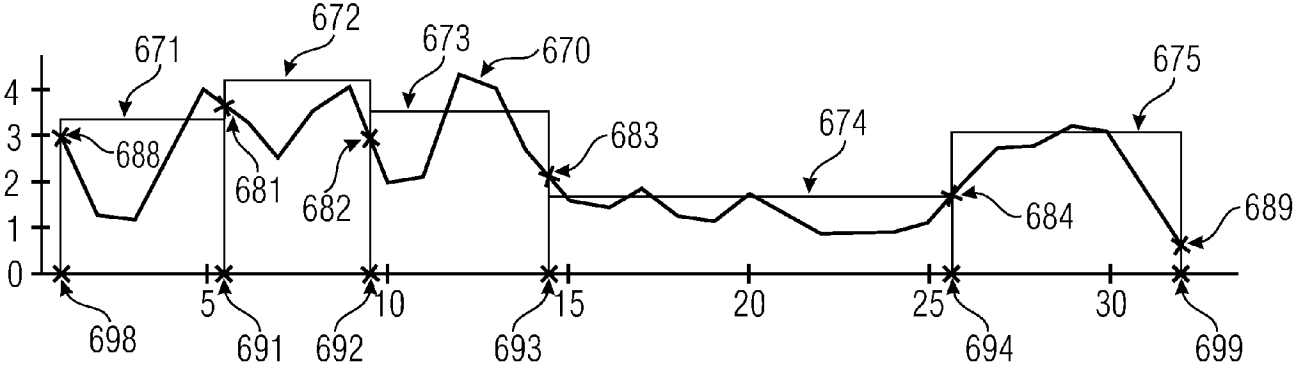

In FIG. 6C, four splitting points for a signal envelope 670 shall be determined. Thus, in this example, the different possible splitting point configurations are defined by four splitting points. In the embodiment of FIG. 6C, splitting points 691, 692, 693, 694 are found as best splitting points. Splitting points 691, 692, 693, 694 divide the audio signal envelope 670 into five signal envelope portions. Rectangle block 671 represents an energy of a first signal envelope portion defined by the splitting points. Rectangle block 672 represents an energy of a second signal envelope portion defined by the splitting points. Rectangle block 673 represents an energy of a third signal envelope portion defined by the splitting points. Rectangle block 674 represents an energy of a fourth signal envelope portion defined by the splitting points. And rectangle block 675 represents an energy of a fifth signal envelope portion defined by the splitting points. In the example of FIG. 6C, the upper edges of blocks 671, 672, 673, 674, 675 represent an estimation of the signal envelope 670. Such an estimation can be made at a decoder, for example, using as information the splitting points 691, 692, 693, 694, information about where the signal envelope begins (here at point 698) and information where the signal envelope ends (here at point 699). The signal envelope may start and may end at fixed values and this information may be available as fixed information at the receiver. Or, this information may be transmitted to the receiver. On the decoder side, the decoder may reconstruct an estimation of the signal envelope such that the signal envelope portions, that result from the splitting points 691, 692, 693, 694 splitting the audio signal envelope, get the same value assigned from the predefined assignment rule. In FIG. 6C, the signal envelope portions of a signal envelope being defined by the upper edges of the blocks 671, 672, 673, 674 gets the same value assigned by the assignment rule and represents a good estimation of the signal envelope 670. Instead of using splitting point 691, 692, 693, 694 values 681, 682, 683, 684 may also be used as splitting points. Moreover, instead of start value 698, value 688 may be used as start value and instead of end value 699, end value 689 may be used as end value. However, not only encoding the abscissa value, but also the ordinate value, necessitates more coding resources and is not necessitated.

As a further particular embodiment, the following example may be considered.

A signal envelope being represented in a spectral domain shall be encoded. The signal envelope may, for example comprise n spectral values. (e.g., n=33).

Different signal envelope portions may now be considered. For example a first signal envelope portion may comprise the first 10 spectral values $v_i$ (i=0, . . . , 9; with i being an index of the spectral value) and the second signal envelope portion may comprise the last 23 spectral values (i=10, . . . , 32).

In an embodiment, a predefined assignment rule, may, for example, be that the signal envelope portion value p(m) of a spectral signal envelope portion m with spectral values $v_0$, $v_1$, . . . , $v_{s-1}$ is the energy of the spectral signal envelope portion, e.g., $$p(m) = \sum_{i=lowerbound}^{upperbound} v_i^2$$

wherein lowerbound is the lower bound value of the signal envelope portion m and wherein upperbound is the upper bound value of the signal envelope portion m.

The signal envelope portion value determiner 110 may assign a signal envelope portion value according to such a formula to one or more of the audio signal envelope portions.

The splitting point determiner 220 is now configured to determine one or more signal envelope portion values according to the predefined assignment rule. In particular, the splitting point determiner 220 is configured to determine the one or more signal envelope portion values depending on the assignment rule such that the signal envelope portion value of each of the two or more signal envelope portions is (approximately) equal to the signal envelope portion value of each of the other signal envelope portions of the two or more signal envelope portions.

For example, in a particular embodiment, the splitting point determiner 220 may be configured to determine a single splitting point only. In such an embodiment, two signal envelope portions, e.g., signal envelope portion 1 (m=1) and signal envelope portion 2 (m=2) are defined by the splitting point s, e.g., according to the formulae:

$$p(1) = \sum_{i=0}^{s-1} v_i^2$$

$$p(2) = \sum_{i=s}^{n-1} v_i^2$$

wherein n indicates the number of samples of the audio signal envelope, e.g., the number of spectral values of the audio signal envelope. In the above example, n may, for example, be n=33.

The signal envelope portion value determiner 110 may assign such a signal envelope portion value p(1) to audio signal envelope portion 1 and such a signal envelope portion value p(2) to audio signal envelope portion 2.

In some embodiments, both signal envelope portion values p(1), p(2) are determined. However, in some embodiments, only one of both signal envelope portion values is considered. For example, if the total energy is known. Then, it is sufficient to determine the splitting point such that p(1) is roughly 50% of the total energy.

In some embodiments, s(k) may be selected from a set of possible values, for example, from a set of integer index values, e.g., {0; 1; 2; . . . ; 32}. In other embodiments, s(k) may be selected from a set of possible values, for example, from a set of frequency values indicating a set of frequency bands.

In embodiments, where more than one splitting point shall be determined, a formula representing a cumulated energy, cumulating the sample energies until just before splitting point s may be considered $$\sum_{i=0}^{s-1} v_i^2$$

If N splitting points shall be determined, then the splitting points s(1), s(2), . . . s(N) are determined such that:

$$\sum_{i=0}^{s(k)-1} v_i^2 \approx k\frac{totalenergy}{N+1}$$

wherein totalenergy is the total energy of the signal envelope.

In an embodiment, the splitting point s(k) may be chosen, such that $$\left|\left(\sum_{i=0}^{s(k)-1} v_i^2\right) - k\frac{totalenergy}{N+1}\right|$$

is minimal.

Thus, according to an embodiment, the splitting point determiner 220 may, e.g., be configured to determine the one or more splitting points s(k), such that $$\left|\left(\sum_{i=0}^{s(k)-1} v_i^2\right) - k\frac{totalenergy}{N+1}\right|$$

is minimal, wherein totalenergy indicates a total energy, and wherein k indicates the k-th splitting point of the one or more splitting points, and wherein N indicates the number of the one or more splitting points.

In another embodiment, if the splitting point determiner 220 is configured to select only a single splitting point s, then, the splitting point determiner 220 may test all possible splitting points s=1, . . . , 32.

In some embodiments, the splitting point determiner 220 may select the best value for the splitting point s, e.g. the splitting point s where $$d = |p(2) - p(1)| = \left|\sum_{i=s}^{n-1} v_i^2 - \sum_{i=0}^{s-1} v_i^2\right|$$

is minimal.

According to an embodiment, the signal envelope portion value of each signal envelope portion of the two or more signal envelope portions may, e.g., depend on one or more energy values or one or more power values of said signal envelope portion. Or, the signal envelope portion value of each signal envelope portion of the two or more signal envelope portions may, e.g., depend on any other value suitable for reconstructing an original or a targeted level of the audio signal envelope.

According to an embodiment, the audio signal envelope may, e.g., be represented in a spectral domain or in a time domain.

Figure 4:
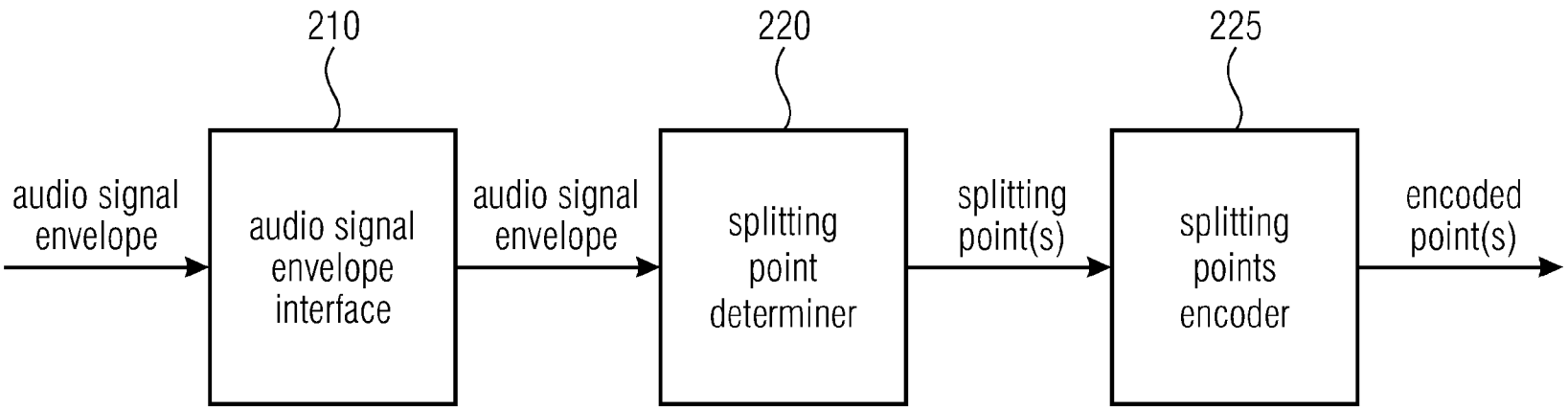
FIG. 4 illustrates an apparatus for encoding an audio signal envelope according to another embodiment, wherein the apparatus further comprises a splitting points encoder.

FIG. 4 illustrates an apparatus for encoding an audio signal envelope according to another embodiment, wherein the apparatus further comprises a splitting points encoder 225 for encoding the one or more splitting points, e.g., according to an encoding rule, to obtain one or more encoded points.

The splitting points encoder 225 may, e.g., be configured to encode a position of each of the one or more splitting points to obtain one or more encoded points. The splitting points encoder 225 may, e.g., be configured to encode a position of each of the one or more splitting points by encoding a splitting points state number. Moreover, the splitting points encoder 225 may, e.g., be configured to provide a total positions number indicating a total number of possible splitting point positions, and a splitting points number indicating the number of the one or more splitting points. The splitting points state number, the total positions number and the splitting points number together indicate the position of each of the one or more splitting points.

Figure 5:
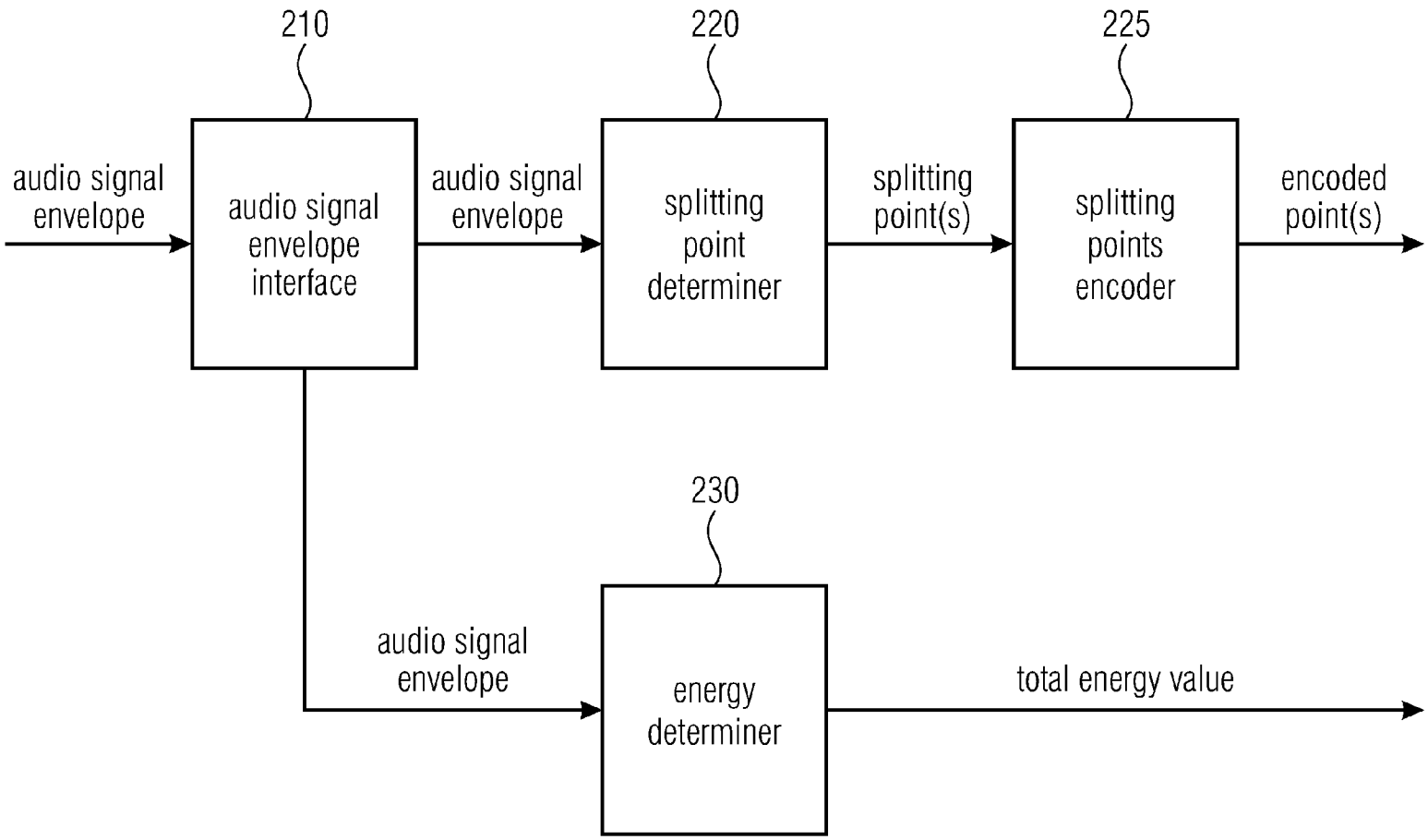
FIG. 5 illustrates an apparatus for encoding an audio signal envelope according to another embodiment, wherein the apparatus for encoding an audio signal envelope further comprises an energy determiner.

FIG. 5 illustrates an apparatus for encoding an audio signal envelope according to another embodiment, wherein the apparatus for encoding an audio signal envelope further comprises an energy determiner 230.

According to an embodiment, the apparatus may, e.g., further comprise an energy determiner (230) for determining a total energy of the audio signal envelope and for encoding the total energy of the audio signal envelope.

In another embodiment, however, the apparatus may, e.g., be furthermore configured to determine any other value suitable for reconstructing an original or a targeted level of the audio signal envelope. Instead of the total energy, a plurality of other values is suitable for reconstructing an original or a targeted level of the audio signal envelope. For example, as already mentioned, the scaling of the envelope may be implemented in various ways, and as it can correspond to signal energy or spectral mass or similar (an absolute size), or it can be a scaling or gain factor (a relative size), it can be encoded as an absolute or relative value, or it can be encoded by a difference to a previous value or to a combination of previous values. In some cases the scaling can also be irrelevant or deduced from other available data. The envelope shall be reconstructed to its original or a targeted level.

Figure 14A:
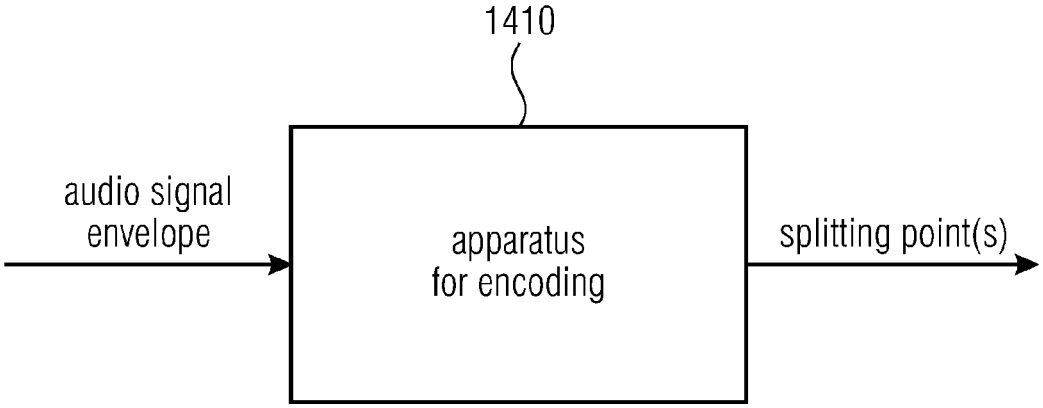
FIGS. 14A and 14B illustrate an apparatus for encoding an audio signal according to an embodiment.
Figure 14B:
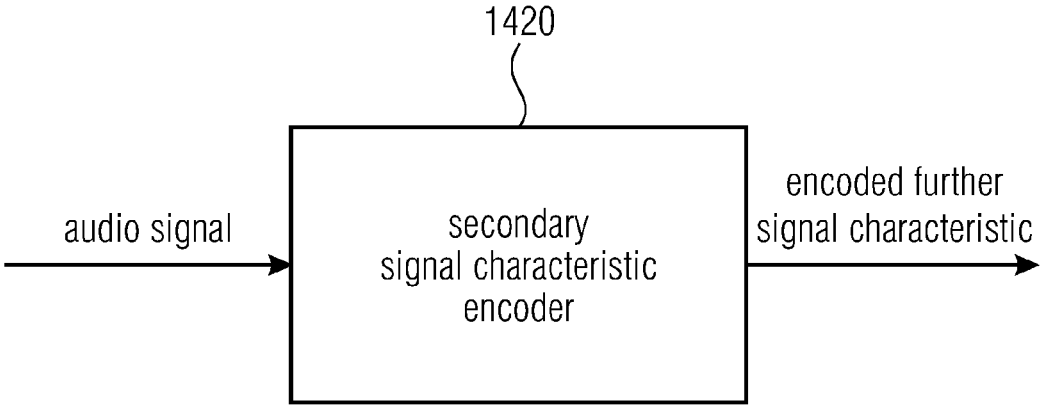

FIGS. 14A and 14B illustrate an apparatus for encoding an audio signal. The apparatus comprises an apparatus 1410 for encoding according to one of the above-described embodiments for encoding an audio signal envelope of the audio signal by generating one or more splitting points, and a secondary signal characteristic encoder 1420 for encoding a further signal characteristic of the audio signal, the further signal characteristic being different from the audio signal envelope. A person skilled in the art is aware that from a signal envelope of an audio signal and from a further signal characteristic of the audio signal, the audio signal itself can be reconstructed. For example, the signal envelope may, e.g., indicate the energy of the samples of the audio signal. The further signal characteristic may, for example, indicate for each sample of, for example, a time-domain audio signal, whether the sample has a positive or negative value.

Figure 1:
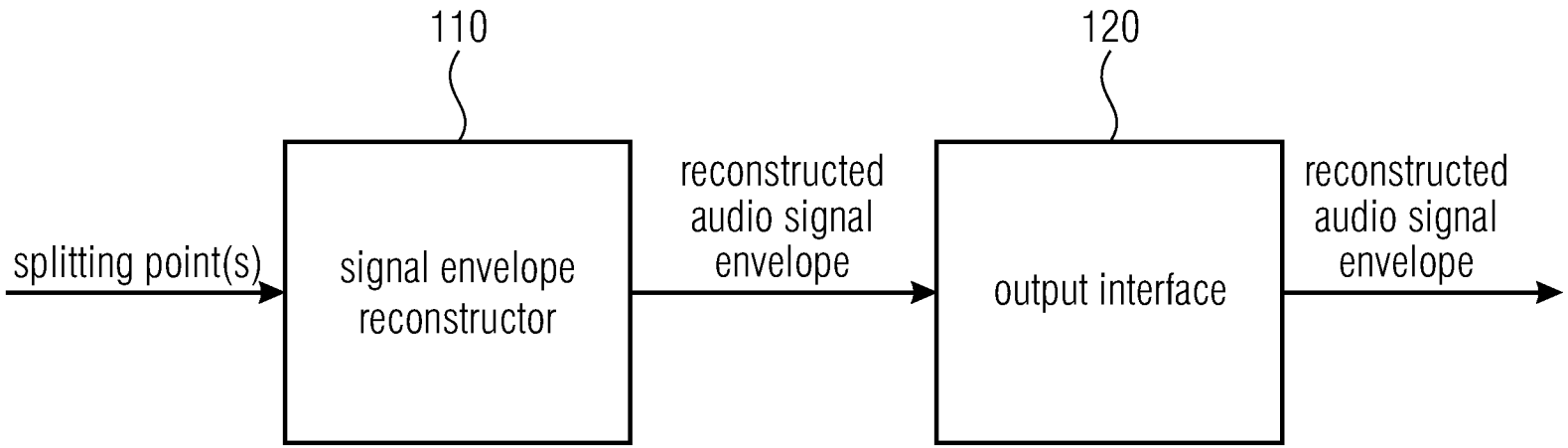
FIG. 1 illustrates an apparatus for decoding to obtain a reconstructed audio signal envelope according to an embodiment.

FIG. 1 illustrates an apparatus for decoding to obtain a reconstructed audio signal envelope according to an embodiment.

The apparatus comprises a signal envelope reconstructor 110 for generating the reconstructed audio signal envelope depending on one or more splitting points.

Moreover, the apparatus comprises an output interface 120 for outputting the reconstructed audio signal envelope.

The signal envelope reconstructor 110 is configured to generate the reconstructed audio signal envelope such that the one or more splitting points divide the reconstructed audio signal envelope into two or more audio signal envelope portions.

A predefined assignment rule defines a signal envelope portion value for each signal envelope portion of the two or more signal envelope portions depending on said signal envelope portion.

Moreover, the signal envelope reconstructor 110 is configured to generate the reconstructed audio signal envelope such that, for each of the two or more signal envelope portions, an absolute value of its signal envelope portion value is greater than half of an absolute value of the signal envelope portion value of each of the other signal envelope portions.

Regarding the absolute value a of a signal envelope portion value x means:

If $x \geq 0$ then $a=x$; and

If $x<0$ then $a=-x$.

If all signal envelope portion values are positive, this above formulation means that the reconstructed audio signal envelope is generated such that, for each of the two or more signal envelope portions, its signal envelope portion value is greater than half of the signal envelope portion value of each of the other signal envelope portions.

In a particular embodiment, the signal envelope portion value of each of the signal envelope portions is equal to the signal envelope portion value of each of the other signal envelope portions of the two or more signal envelope portions.

However, in the more general embodiment of FIG. 1, the audio signal envelope is reconstructed so that the signal envelope portion values of the signal envelope portions do not have to be exactly equal. Instead, some degree of tolerance (some margin) is allowed.

The formulation, "such that, for each of the two or more signal envelope portions, an absolute value of its signal envelope portion value is greater than half of an absolute value of the signal envelope portion value of each of the other signal envelope portions", may, e.g., be understood to mean that as long as the greatest absolute value of all signal envelope portion values does not have twice the size of the smallest absolute value of all signal envelope portion values, the necessitated condition is fulfilled.

For example, a set of four signal envelope portion values $\{0.23; 0.28; 0.19; 0.30\}$ fulfils the above requirement, as $0.30<2\cdot0.19=0.38$. Another set of four signal envelope portion values, however, $\{0.24; 0.16; 0.35; 0.25\}$ does not fulfil the necessitated condition, as $0.35>2\cdot0.16=0.32$.

On a decoder side, the signal envelope reconstructor 110 is configured to reconstruct the reconstructed audio signal envelope, such that the audio signal envelope portions resulting from the splitting points dividing the reconstructed audio signal envelope, have signal envelope portion values which are roughly equal. Thus, the signal envelope portion value of each of the two or more signal envelope portions is greater than half of the signal envelope portion value of each of the other signal envelope portions of the two or more signal envelope portions.

In such embodiments, the signal envelope portion values of the signal envelope portions shall be roughly equal, but do not have to be exactly equal.

Demanding that the signal envelope portion values of the signal envelope portions shall be quite equal indicates to the decoder how the signal shall be reconstructed. When the signal envelope portions are reconstructed such that the signal envelope portion values are exactly equal, the degree of freedom in reconstructing the signal on the decoder side is severely restricted.

The more the signal envelope portion values may deviate from each other, the more freedom has the decoder to adjust the audio signal envelope according to a specification on the decoder side. For example, when a spectral audio signal envelope is encoded, some decoders may favour to put more, e.g., energy on the lower frequency bands while other decoders may favour to put more, e.g., energy on the higher frequency bands. And, by allowing some tolerance, a limited amount of rounding errors, e.g., caused by quantization and/or dequantization, may be allowable.

In an embodiment, where the signal envelope reconstructor 110 is reconstructing quite exact, the signal envelope reconstructor 110 is configured to generate the reconstructed audio signal envelope such that, for each of the two or more signal envelope portions, the absolute value of its signal envelope portion value is greater than 90% of the absolute value of the signal envelope portion value of each of the other signal envelope portions.

According to an embodiment, the signal envelope reconstructor 110 may, e.g., be configured to generate the reconstructed audio signal envelope such that, for each of the two or more signal envelope portions, the absolute value of its signal envelope portion value is greater than 99% of the absolute value of the signal envelope portion value of each of the other signal envelope portions.

In another embodiment, however, the signal envelope reconstructor 110 may, e.g., be configured to generate the reconstructed audio signal envelope such that the signal envelope portion value of each of the two or more signal envelope portions is equal to the signal envelope portion value of each of the other signal envelope portions of the two or more signal envelope portions.

In an embodiment, the signal envelope portion value of each signal envelope portion of the two or more signal envelope portions may, e.g., depend on one or more energy values or one or more power values of said signal envelope portion.

According to an embodiment, the reconstructed audio signal envelope may, e.g., be represented in a spectral domain or in a time domain.

Figure 2:
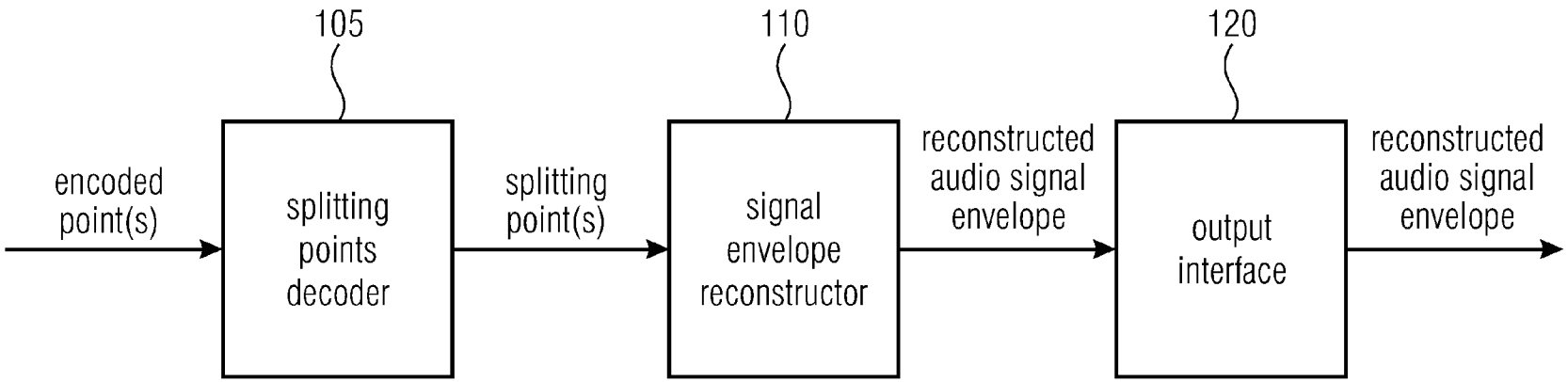
FIG. 2 illustrates an apparatus for decoding according to a further embodiment, wherein the apparatus further comprises a splitting points decoder.

FIG. 2 illustrates an apparatus for decoding according to a further embodiment, wherein the apparatus further comprises a splitting points decoder 105 for decoding one or more encoded points according to a decoding rule to obtain the one or more splitting points.

According to an embodiment, the signal envelope reconstructor 110 may, e.g., be configured to generate the reconstructed audio signal envelope depending on a total energy value indicating a total energy of the reconstructed audio signal envelope, or depending on any other value suitable for reconstructing an original or a targeted level of the audio signal envelope.

Now, to illustrate the present invention in more detail, particular embodiments are provided.

According to a particular embodiment, a concept is to split the frequency band into two parts such that both halves have equal energy. This idea is depicted in FIG. 6A, where the envelope, that is, the overall shape, is described by constant energy blocks.

The idea can then be recursively applied, such that both of the two halves are further split into two halves, which have equal energy. This approach is illustrated in FIG. 6B.

More generally, the spectrum can be divided in N blocks such that each block has 1/Nth of the energy. In FIG. 6C, this is illustrated with N=5.

To reconstruct these block-wise constant spectral envelopes in the decoder, the frequency-borders of the blocks and, e.g., the overall energy may, e.g., be transmitted. The frequency-borders then correspond, but only in a heuristic sense, to the LSF representation of the LPC.

So far, explanations have been provided with respect to the energy envelope abs(x)2 of a signal x. In other embodiments, however, the magnitude envelope abs(x), some other power abs(x)n of the spectrum or any perceptually motivated representation (e.g. loudness) is modeled. Instead of energy, one could refer to the term "spectral mass" and assume that it describes an appropriate representation of the spectrum. The only important thing is that it is possible to calculate the cumulative sum of the spectrum representation, that is, that the representation has only positive values.

However, if a sequence is not positive, it can be converted to a positive sequence by addition of a sufficiently large constant, by taking its cumulative sum or by other suitable operations. Similarly, a complex-valued sequence can be converted to, for example, 1) two sequences of which one purely real and one purely imaginary, or
2) two sequences of which the first one represents the magnitude and the second the phase. These two sequences can then in both cases be modeled as two separate envelopes.

It is also not necessitated to constrain the model to spectral envelope models, any envelope shape can be described with the current model. For example, Temporal Noise Shaping (TNS) (see Herre, Jurgen, and James D. Johnston. "Enhancing the performance of perceptual audio coders by using temporal noise shaping (TNS)." *Audio Engineering Society Convention* 101. 1996) is a standard tool in audio codecs, which models the temporal envelope of a signal. Since our method models envelopes, it can equally well be applied to time-domain signals as well.

Similarly, band-width extension (BWE) methods apply spectral envelopes to model the spectral shape of the higher frequencies and the proposed method can thus be applied for BWE as well.

Figure 17:
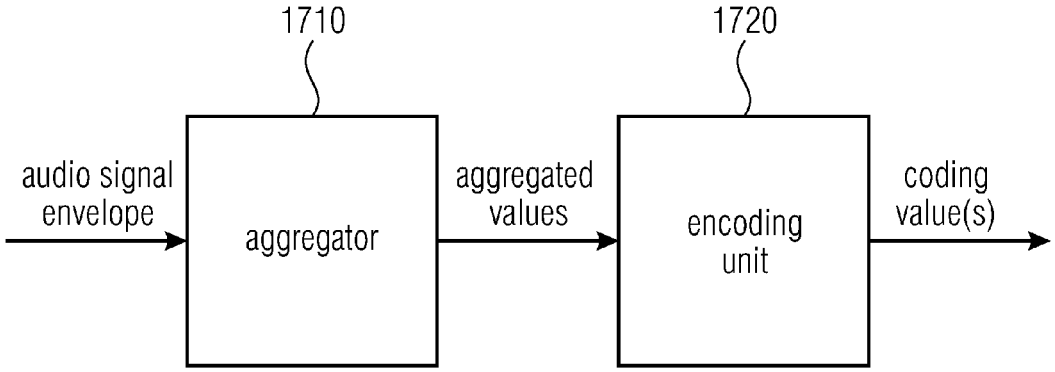
FIG. 17 illustrates an apparatus for determining one or more coding values for encoding an audio signal envelope according to an embodiment.

FIG. 17 illustrates an apparatus for determining one or more coding values for encoding an audio signal envelope according to an embodiment.

The apparatus comprises an aggregator 1710 for determining an aggregated value for each of a plurality of argument values. The plurality of argument values are ordered such that a first argument value of the plurality of argument values either precedes or succeeds a second argument value of the plurality of argument values, when said second argument value is different from the first argument value.

An envelope value is assigned to each of the argument values, wherein the envelope value of each of the argument values depends on the audio signal envelope, and wherein the aggregator is configured to determine the aggregated value for each argument value of the plurality of argument values depending on the envelope value of said argument value, and depending on the envelope value of each of the plurality of argument values which precede said argument value.

Moreover, the apparatus comprises an encoding unit 1720 for determining one or more coding values depending on one or more of the aggregated values of the plurality of argument values. For example, the encoding unit 1720 may generate the above-described one or more splitting points as the one or more coding values, e.g., as described above.

Figure 18:
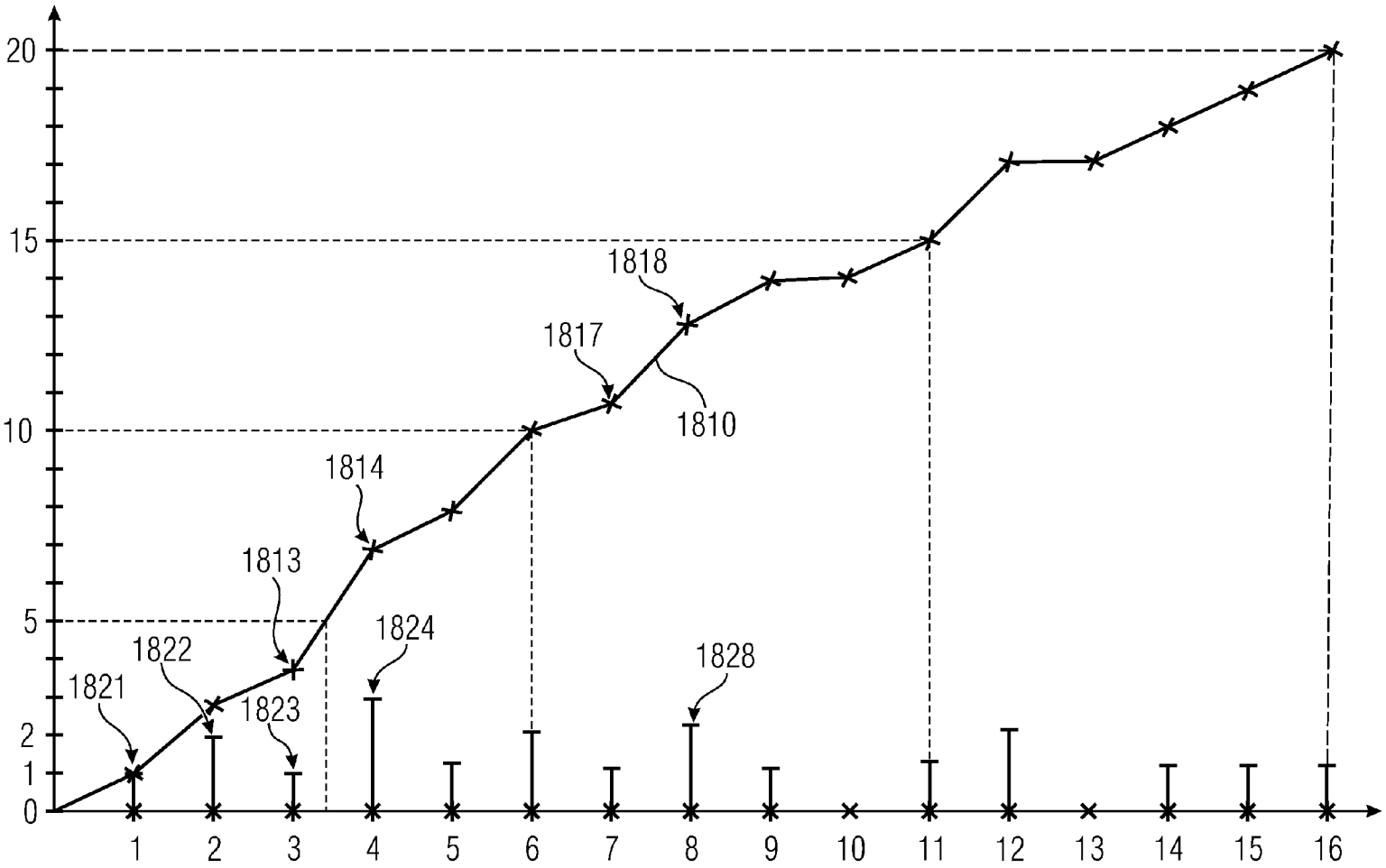
FIG. 18 illustrates an aggregation function according to a first example.

FIG. 18 illustrates an aggregation function 1810 according to a first example.

Inter alia, FIG. 18 illustrates 16 envelope points of an audio signal envelope. For example, the 4th envelope point of the audio signal envelope is indicated by reference sign 1824 and the 8th envelope point is indicated by reference sign 1828. Each envelope point comprises an argument value and an envelope value. Spoken differently, the argument value may be considered as an x-component and the envelope value may be considered as a y-component of the envelope point in an xy-coordinate system. So, as can be seen in FIG. 18, the argument value of the 4th envelope point 1824 is 4 and the envelope value of the 4th envelope point is 3. As another example, the argument value of the 8th envelope point 1828 is 8 and the envelope value of the 4th envelope point is 2. In other embodiments, the argument values may not indicate an index number as in FIG. 18, but may, for example, indicate a center frequency of a spectral band, if, e.g., a spectral envelope is considered, so that, for example, a first argument value may then be 300 Hz, a second argument value may be 500 Hz, etc. Or, for example, in other embodiments, the argument values may indicate points in time, if, e.g., a temporal envelope is considered.

The aggregation function 1810 comprises a plurality of aggregation points. For example, consider the 4th aggregation point 1814 and the 8th aggregation point 1818. Each aggregation point comprises an argument value and an aggregation value. Similarly as above, the argument value may be considered as an x-component and the aggregation value may be considered as an y-component of the aggregation point in an xy-coordinate system. In FIG. 18, the argument value of the 4th aggregation point 1814 is 4 and the aggregation value of the 4th aggregation point 1818 is 7. As another example, the argument value of the 8th envelope point is 8 and the envelope value of the 4th envelope point is 13.

The aggregation value of each aggregation point of the aggregation function 1810 depends on the envelope value of the envelope point having the same argument value as the considered aggregation point, and further depends on the envelope value of each of the plurality of argument values which precede said argument value. In the example of FIG. 18, regarding the 4th aggregation point 1814, its aggregation value depends on the envelope value of the 4th envelope point 1824, as this envelope point has the same argument value as the aggregation point, and further depends on the envelope values of the envelope points 1821, 1822 and 1823, as the argument values of these envelope points 1821, 1822, 1823 precede the argument value of the envelope point 1824.

In the example of FIG. 18, the aggregation value of each aggregation point is determined by summing the envelope value of the corresponding envelope point and the envelope values of its preceding envelope points. Thus, the aggregation value of the 4th aggregation point is 1+2+1+3=7 (as the envelope value of the 1st envelope point is 1, as the envelope value of the 2nd envelope point is 2, as the envelope value of the 3rd envelope point is 1, and as the envelope value of the 4th envelope point is 3). Correspondingly, the aggregation value of the 8th aggregation point is 1+2+1+3+1+2+1+2=13.

The aggregation function is monotonically increasing. This, e.g., means that each aggregation point of the aggregation function (which has a predecessor) has an aggregation value that is greater than or equal to the aggregation value of its immediately preceding aggregation point. For example, regarding the aggregation function 1810, e.g., the aggregation value of the 4th aggregation point 1814 is greater than or equal to the aggregation value of the 3rd aggregation point; the aggregation value of the 8th aggregation point 1818 is greater than or equal to the aggregation value of the 7th aggregation point 1817, and so on, and this holds true for all aggregation points of the aggregation function.

Figure 19:
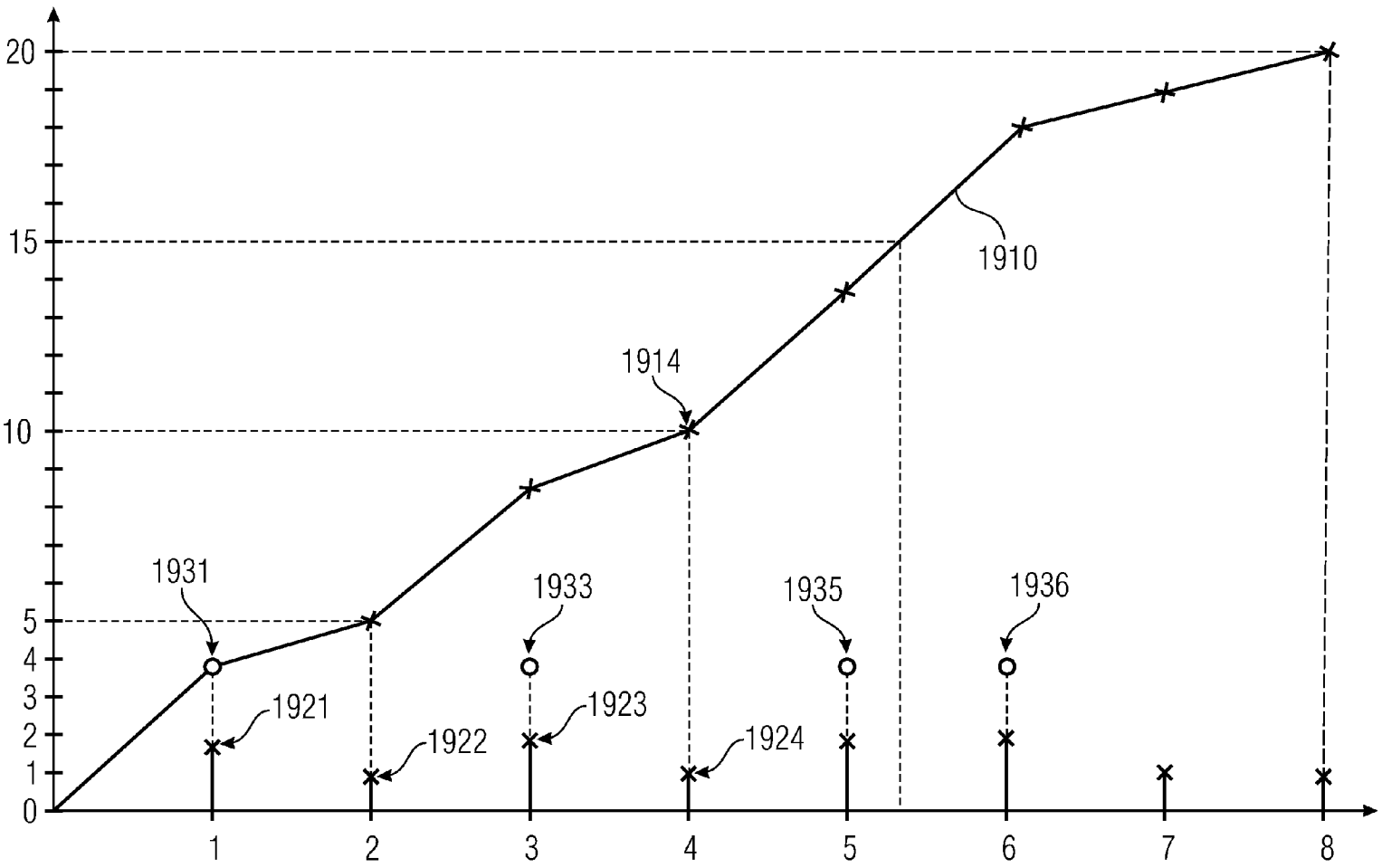
FIG. 19 illustrates an aggregation function according to a second example.

FIG. 19 shows another example for an aggregation function, there, aggregation function 1910. In the example of FIG. 19, the aggregation value of each aggregation point is determined by summing the square of the envelope value of the corresponding envelope point and the squares of the envelope values of its preceding envelope points. Thus, for example, to obtain the aggregation value of the 4th aggregation point 1914, the square of the envelope value of the corresponding envelope point 1924, and the squares of the envelope values of its preceding envelope points 1921, 1922 and 1923 are summed, resulting to 22+12+22+12=10. So the aggregation value of the 4th aggregation point 1914 in FIG. 19 is 10. In FIG. 19, reference signs 1931, 1933, 1935 and 1936 indicate the squares of the envelope values of the respective envelope points, respectively.

What can also be seen from FIGS. 18 and 19 is that aggregation functions provide an efficient way to determine splitting points. Splitting points are an example for coding values. In FIG. 18, the greatest aggregation value of all splitting points (this may, for example, be a total energy) is 20.

For example, if only one splitting point should be determined, that argument value of the aggregation point may, for example, be chosen as splitting point, that is equal to or close to 10 (50% of 20). In FIG. 18, this argument value would be 6 and the single splitting point would, e.g., be 6.

If three splitting points should be determined, the argument values of the aggregation points may be chosen as splitting points, that are equal to or close to 5, 10 and 15 (25%, 50%, and 75% of 20), respectively. In FIG. 18, these argument values would be either 3 or 4, 6 and 11. Thus, the chosen splitting points would be either 3, 6, and 11; or would be 4, 6, and 11. In other embodiments, non-integer values may be allowed as splitting points and then, in FIG. 18, the determined splitting points would, e.g., be 3.33, 6 and 11.

So, according to some embodiments, the aggregator may, e.g., be configured to determine the aggregated value for each argument value of the plurality of argument values by adding the envelope value of said argument value and the envelope values of the argument values which precede said argument value.

In an embodiment, the envelope value of each of the argument values may, e.g., indicate an energy value of an audio signal envelope having the audio signal envelope as signal envelope.

According to an embodiment, the envelope value of each of the argument values may, e.g., indicate an n-th power of a spectral value of an audio signal envelope having the audio signal envelope as signal envelope, wherein n is an even integer greater zero.

In an embodiment, the envelope value of each of the argument values may, e.g., indicate an n-th power of an amplitude value of an audio signal envelope, being represented in a time domain, and having the audio signal envelope as signal envelope, wherein n is an even integer greater zero.

According to an embodiment, the encoding unit may, e.g., be configured to determine the one or more coding values depending on one or more of the aggregated values of the argument values, and depending on a coding values number, which indicates how many values are to be determined by the encoding unit as the one or more coding values.

In an embodiment, the coding unit may, e.g., be configured to determine the one or more coding values according to $$c(k) - \min_j \left( \left| a(j) - k \frac{\max(a)}{N} \right| \right),$$

wherein c(k) indicates the k-th coding value to be determined by the coding unit, wherein j indicates the j-th argument value of the plurality of argument values, wherein a(j) indicates the aggregated value being assigned to the j-th argument value, wherein max(a) indicates a maximum value being one of the aggregated values which are assigned to one of the argument values, wherein none of the aggregated values which are assigned to one of the argument values is greater than the maximum value, and wherein $$\min_j \left( \left| a(j) - k \frac{\max(a)}{N} \right| \right)$$

indicates a minimum value being one of the argument values for which $$\left| a(j) - k \frac{\max(a)}{N} \right|$$

is minimal.

Figure 16:
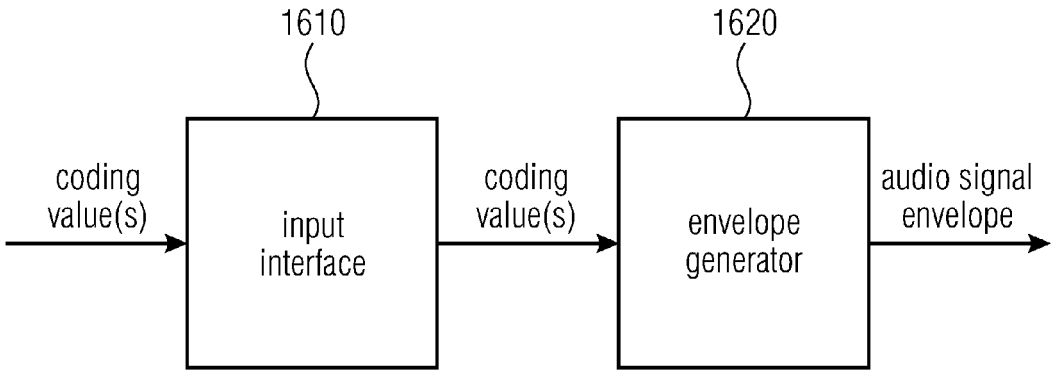
FIG. 16 illustrates an apparatus for generating an audio signal envelope from one or more coding values according to an embodiment.

FIG. 16 illustrates an apparatus for generating an audio signal envelope from one or more coding values according to an embodiment.

The apparatus comprises an input interface 1610 for receiving the one or more coding values, and an envelope generator 1620 for generating the audio signal envelope depending on the one or more coding values.

The envelope generator 1620 is configured to generate an aggregation function depending on the one or more coding values, wherein the aggregation function comprises a plurality of aggregation points, wherein each of the aggregation points comprises an argument value and an aggregation value, wherein the aggregation function monotonically increases.

Each of the one or more coding values indicates at least one of the argument value and the aggregation value of one of the aggregation points of the aggregation function. This means, that each of the coding values specifies an argument value of one of the aggregation points or specifies an aggregation value of one of the aggregation points or specifies both an argument value and an aggregation value of one of the aggregation points of the aggregation function. In other words, each of the one or more coding values indicates the argument value and/or the aggregation value of one of the aggregation points of the aggregation function.

Moreover, the envelope generator 1620 is configured to generate the audio signal envelope such that the audio signal envelope comprises a plurality of envelope points, wherein each of the envelope points comprises an argument value and an envelope value, and wherein, for each of the aggregation points of the aggregation function, one of the envelope points of the audio signal envelope is assigned to said aggregation point such that the argument value of said envelope point is equal to the argument value of said aggregation point. Furthermore, the envelope generator 1620 is configured to generate the audio signal envelope such that the envelope value of each of the envelope points of the audio signal envelope depends on the aggregation value of at least one aggregation point of the aggregation function.

According to an embodiment, the envelope generator 1620 may, e.g., be configured to determine the aggregation function by determining one of the aggregation points for each of the one or more coding values depending on said coding value, and by applying interpolation to obtain the aggregation function depending on the aggregation point of each of the one or more coding values.

According to an embodiment, the input interface 1610 may be configured to receive one or more splitting values as the one or more coding values. The envelope generator 1620 may be configured to generate the aggregation function depending on the one or more splitting values, wherein each of the one or more splitting values indicates the aggregation value of one of the aggregation points of the aggregation function. Moreover, the envelope generator 1620 may be configured to generate the reconstructed audio signal envelope such that the one or more splitting points divide the reconstructed audio signal envelope into two or more audio signal envelope portions. A predefined assignment rule defines a signal envelope portion value for each signal envelope portion of the two or more signal envelope portions depending on said signal envelope portion. Furthermore, the envelope generator 1620 may be configured to generate the reconstructed audio signal envelope such that, for each of the two or more signal envelope portions, an absolute value of its signal envelope portion value is greater than half of an absolute value of the signal envelope portion value of each of the other signal envelope portions.

In an embodiment, the envelope generator 1620 may, e.g., be configured to determine a first derivate of the aggregation function at a plurality of the aggregation points of the aggregation function.

According to an embodiment, the envelope generator 1620 may, e.g., be configured to generate the aggregation function depending on the coding values so that the aggregation function has a continuous first derivative.

In other embodiments, an LPC model may be derived from the quantized spectral envelopes. By taking the inverse Fourier transform of the power spectrum abs(x)2, the autocorrelation is obtained. From this autocorrelation, an LPC model can be readily calculated by conventional methods. Such an LPC model can then be used to create a smooth envelope.

According to some embodiments, a smooth envelope can be obtained by modeling the blocks with splines or other interpolation methods. The interpolations are most conveniently done by modeling the cumulative sum of spectral mass.

Figure 7A:
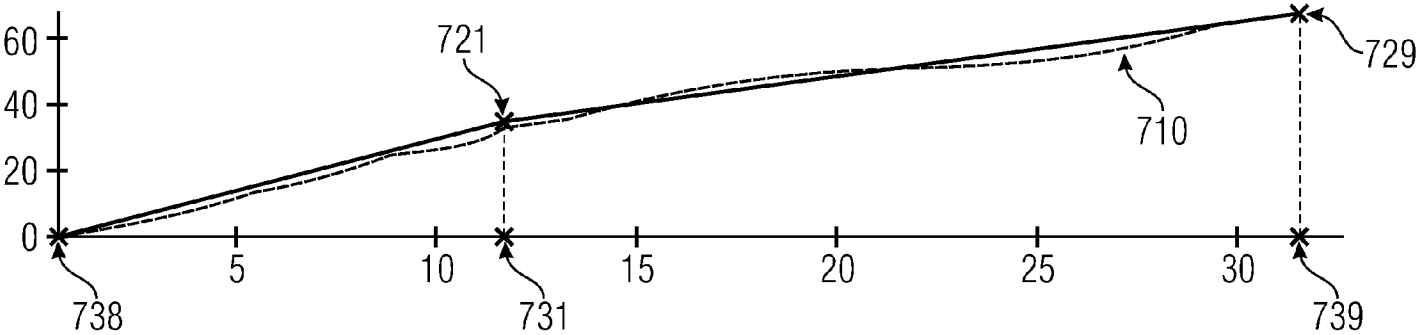
FIGS. 7A-7C illustrate a cumulative representation of the spectra of FIGS. 6A-6C according to embodiments.
Figure 7B:
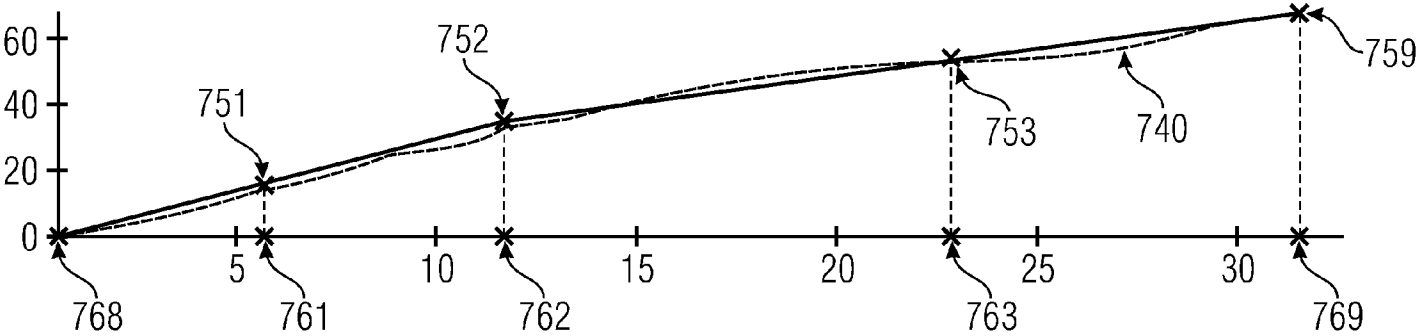
Figure 7C:
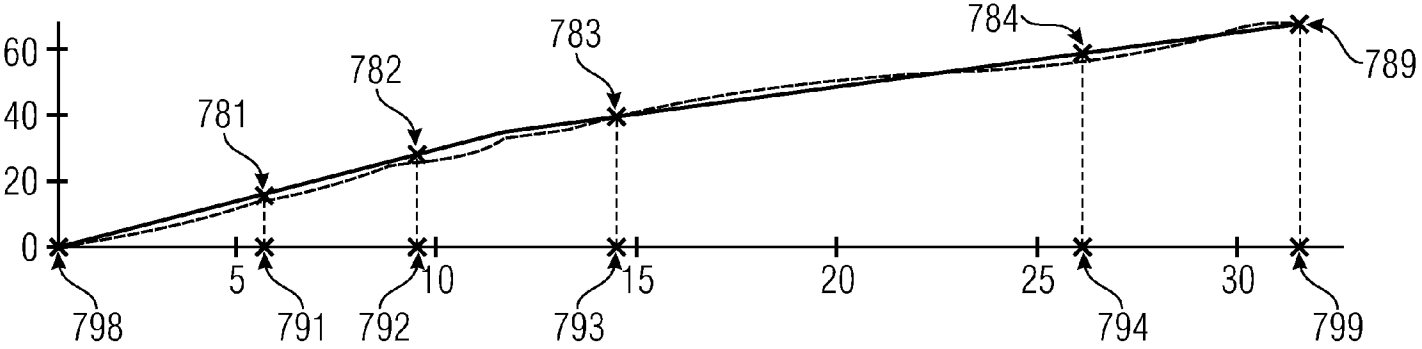

FIGS. 7A-7C illustrate the same spectra as in FIGS. 6A-6C but with their cumulative masses. Line 710 illustrates a cumulative mass-line of the original signal envelope. The points 721 in FIG. 7A, 751, 752, 753 in FIG. 7B, and 781, 782, 783, 784 in FIG. 7C indicate where splitting points should be located.

The step sizes between points 738, 721 and 729 on the y-axis in FIG. 7A are constant. Likewise, the step sizes between points 768, 751, 752, 753 and 759 on the y-axis in 7B are constant. Likewise, the step sizes between points 798, 781, 782, 783, 784 and 789 on the y-axis in FIG. 7C are constant. The dashed line between points 729 and 739 indicates the total value.

In FIG. 7A, point 721 indicates the position of the splitting point 731 on the x-axis. In FIG. 7B, points 751, 752 and 753 indicate the position of the splitting points 761, 762 and 763 on the x-axis, respectively. Likewise, in FIG. 7C, points 781, 782, 783 and 784 indicate the position of the splitting points 791, 792, 793 and 794 on the x-axis, respectively. The dashed lines between points 729 and 739, points 759 and 769, and points 789 and 799, respectively, indicate the total value.

It should be noted that the points 721; 751, 752, 753; 781, 782, 783 and 784, indicating the position of the splitting points 731; 761, 762, 763; 791, 792, 793 and 794, respectively, are on the cumulative mass-line of the original signal envelope, and the step sizes on the y-axis are constant.

In this domain, the cumulative spectral mass can be interpolated by any conventional interpolation algorithm.

To obtain a continuous representation in the original domain, the cumulative domain has to have a continuous first derivative. For example, interpolation can be done using splines, such that for the k-th block, the end-points of the spline are kE/N and (k+1)E/N, where E is the total mass of the spectrum. Moreover, the derivative of the spline at the end-points may be specified, in order to obtain a continuous envelope in the original domain.

One possibility is to specify the derivative (the tilt) for the splitting point k as $$\text{tilt}(k) = \frac{c(k+1) - c(k-1)}{f(k+1) - f(k-1)}$$

where c(k) is the cumulative energy at splitting point k and f(k) is the frequency of splitting point k.

In more general, the points k−1, k, and k+1 may be any kind of coding values.

According to an embodiment, the envelope generator 1620 is configured to determine the audio signal envelope by determining a ratio of a first difference and a second difference. Said first difference is a difference between a first aggregation value (c(k+1)) of a first one of the aggregation points of the aggregation function and a second aggregation value (c(k−1) or c(k)) of a second one of the aggregation points of the aggregation function. Said second difference is a difference between a first argument value (f(k+1)) of said first one of the aggregation points of the aggregation function and a second argument value (f(k−1) or f(k)) of said second one of the aggregation points of the aggregation function.

In a particular embodiment, the envelope generator 1620 is configured to determine the audio signal envelope by applying $$\text{tilt}(k) = \frac{c(k+1) - c(k-1)}{f(k+1) - f(k-1)}$$

wherein tilt(k) indicates a derivative of the aggregation function at the k-th coding value, wherein c(k+1) is said first aggregation value, wherein f(k+1) is said first argument value, wherein c(k−1) is said second aggregation value, wherein f(k−1) is said second argument value, wherein k is an integer indicating an index of one of the one or more coding values, wherein c(k+1)−c(k−1) is the first difference of the two aggregated values c(k+1) and c(k−1), and wherein f(k+1)−f(k−1) is the second difference of the two argument values f(k+1) and f(k−1).

For example, c(k+1) is said first aggregation value, being assigned to the k+1-th coding value. f(k+1) is said first argument value, being assigned to the k+1-th coding value. c(k−1) is said second aggregation value, being assigned to the k−1-th coding value. f(k−1) is said second argument value, being assigned to the k−1-th coding value.

In another embodiment, the envelope generator 1620 is configured to determine the audio signal envelope by applying $$\text{tilt}(k) = 0.5 \cdot \left( \frac{c(k+1) - c(k)}{f(k+1) - f(k)} + \frac{c(k) - c(k-1)}{f(k) - f(k-1)} \right)$$

wherein tilt(k) indicates a derivative of the aggregation function at the k-th coding value, wherein c(k+1) is said first aggregation value, wherein f(k+1) is said first argument value, wherein c(k) is said second aggregation value, wherein f(k) is said second argument value, wherein c(k−1) is a third aggregation value of a third one of the aggregation points of the aggregation function, wherein f(k−1) is a third argument value of said third one of the aggregation points of the aggregation function, wherein k is an integer indicating an index of one of the one or more coding values, wherein c(k+1)−c(k) is the first difference of the two aggregated values c(k+1) and c(k), and wherein f(k+1)−f(k) is the second difference of the two argument values f(k+1) and f(k).

For example, c(k+1) is said first aggregation value, being assigned to the k+1-th coding value. f(k+1) is said first argument value, being assigned to the k+1-th coding value. c(k) is said second aggregation value, being assigned to the k-th coding value. f(k) is said second argument value, being assigned to the k-th coding value. c(k−1) is said third aggregation value, being assigned to the k−1-th coding value. f(k−1) is said third argument value, being assigned to the k−1-th coding value.

By specifying that an aggregation value is assigned to a k-th coding value, this, e.g., means, that the k-th coding value indicates said aggregation value, and/or that the k-th coding value indicates the argument value of the aggregation point to which said aggregation value belongs.

By specifying that an argument value is assigned to a k-th coding value, this, e.g., means, that the k-th coding value indicates said argument value, and/or that the k-th coding value indicates the aggregation value of the aggregation point to which said argument value belongs.

In particular embodiments, the coding values k−1, k, and k+1 are splitting points, e.g., as described above.

For example, in an embodiment, the signal envelope reconstructor 110 of FIG. 1 may, e.g., be configured to generate an aggregation function depending on the one or more splitting points, wherein the aggregation function comprises a plurality of aggregation points, wherein each of the aggregation points comprises an argument value and an aggregation value, wherein the aggregation function monotonically increases, and wherein each of the one or more splitting points indicates at least one of an argument value and an aggregation value of one of the aggregation points of the aggregation function.

In such an embodiment, the signal envelope reconstructor 110 may, e.g., be configured to generate the audio signal envelope such that the audio signal envelope comprises a plurality of envelope points, wherein each of the envelope points comprises an argument value and an envelope value, and wherein an envelope point of the audio signal envelope is assigned to each of the aggregation points of the aggregation function such that the argument value of said envelope point is equal to the argument value of said aggregation point.

Furthermore, in such an embodiment, the signal envelope reconstructor 110 may, e.g., be configured to generate the audio signal envelope such that the envelope value of each of the envelope points of the audio signal envelope depends on the aggregation value of at least one aggregation point of the aggregation function.

In a particular embodiment, the signal envelope reconstructor 110 may, for example, be configured to determine the audio signal envelope by determining a ratio of a first difference and a second difference, said first difference being a difference between a first aggregation value (c(k+1)) of a first one of the aggregation points of the aggregation function and a second aggregation value (c(k−1); c(k)) of a second one of the aggregation points of the aggregation function, and said second difference being a difference between a first argument value (f(k+1)) of said first one of the aggregation points of the aggregation function and a second argument value (f(k−1); f(k)) of said second one of the aggregation points of the aggregation function. For this purpose, the signal envelope reconstructor 110 may be configured to implement one of the above described concepts as explained for the envelope generator 1620.

The left and right-most edges cannot use the above equation for tilt since c(k) and f(k) are not available outside their range of definition. Those c(k) and f(k) which are outside the range of k are then replaced by the values at the end points themselves, such that $$\text{tilt}(0) = \frac{c(1) - c(0)}{f(1) - f(0)}$$

and $$\text{tilt}(N-1) = \frac{c(N-1) - c(N-2)}{f(N-1) - f(N-2)}$$

Since there are four constraints (cumulative mass and tilt at both end-points), the corresponding spline can be chosen to be a 4th order polynomial.

Figure 8A:
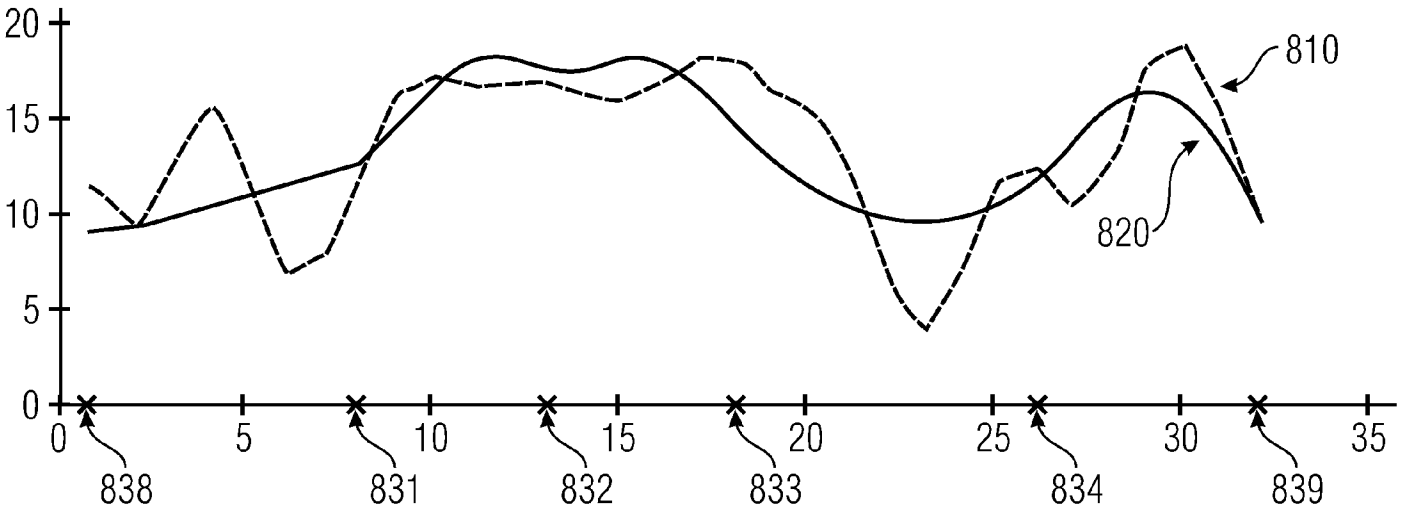
FIGS. 8A and 8B illustrate an interpolated spectral mass envelope in both an original representation as well as in a cumulative mass domain representation.
Figure 8B:
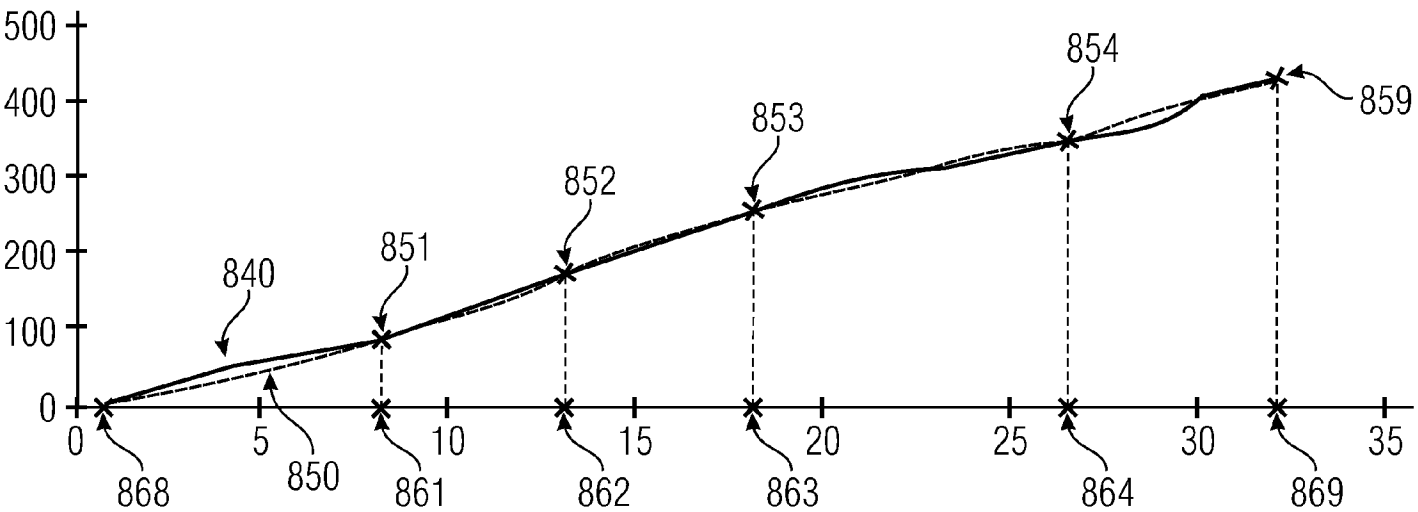

FIGS. 8A and 8B illustrate an example of the interpolated spectral mass envelope in both FIG. 8A original and FIG. 8B cumulative mass domain.

In FIG. 8A, the original signal envelope is indicated by 810 and the interpolated spectral mass envelope is indicated by 820. The splitting points are indicated by 831, 832, 833 and 834, respectively. 838 indicates the start of the signal envelope and 839 indicates the end of the signal envelope.

In FIG. 8B, 840 indicates the cumulated original signal envelope, and 850 indicates the cumulated spectral mass envelope. The splitting points are indicated by 861, 862, 863 and 864, respectively. The position of the splitting points is indicated by points 851, 852, 853 and 854 on the cumulated original signal envelope 840, respectively. 868 indicates the start of the original signal envelope and 869 indicates the end of the original signal envelope on the x-axis. The line between 869 and 859 indicates the total value.

Embodiments provide concepts for coding of the frequencies which separate the blocks. The frequencies represent an order list of scalars fk, that is, fk<fk+1. If there are K+1 blocks, then there are K splitting points.

Further, if there are N quantization levels, then there are $$\binom{N}{K}$$

possible quantizations. For example, with 32 quantization levels and 5 splitting points, there are 201376 possible quantizations which can be encoded with 18 bits.

It should be observed that the Transient Steering Decorrelator (TSD) tool in MPEG USAC (see Kuntz, A., Disch, S., Bäckström, T., and Robilliard, J. "The Transient Steering Decorrelator Tool in the Upcoming MPEG Unified Speech and Audio Coding Standard". In *Audio Engineering Society Convention* 131, October 2011), has a similar problem of encoding K positions with a range of 0 to N−1, whereby the same or a similar enumeration technique may be used to encode the frequencies of the current problem. The benefit of this coding algorithm is that it has a constant bit-consumption.

Alternatively, to further improve accuracy or reduce bitrate, conventional vector quantization techniques may be used, such as those used for quantization of the LSFs. With such an approach a higher number of quantization levels may be obtained and the quantization with respect of mean distortion may be optimized. The drawback is that then, codebooks may, for example, have to be stored, whereas the TSD approach uses an algebraic enumeration of constellations.

In the following, algorithms according to embodiments are described.

At first, the general application case is considered.

In particular, the following describes a practical application of the proposed distribution quantization method for coding the spectral envelope in an SBR-like scenario.

According to some embodiments, the encoder is configured for:

- Calculation of spectral magnitude or energy values of HF-band from original audio signal, and/or
- Calculation of a predefined (or arbitrary and transmitted) number of K subband-indices splitting the spectral envelope into K+1 blocks of equal block mass, and/or
- Coding of indices using the same algorithm as in TSD (see Kuntz, A., Disch, S., Bäckström, T., and Robilliard, J. "The Transient Steering Decorrelator Tool in the Upcoming MPEG Unified Speech and Audio Coding Standard". In *Audio Engineering Society Convention* 131, October 2011), and/or
- Quantization and coding of total mass of HF-band (e.g. via Huffman) writing of total mass and indices to bitstream.

According to some embodiments, the decoder is configured for:

- Reading of total mass and indices from bitstream and subsequent decoding, and/or
- Approximation of smooth cumulative mass curve via spline interpolation, and/or
- 1st derivative of cumulative mass curve to reconstruct the spectral envelope.

Some embodiments comprise further optional additions.

For example, some embodiments provide warping capabilities: Decreasing the number of possible quantization levels leads to a reduction of necessitated bits for coding the splitting points and additionally lowers the computational complexity. This effect can be exploited by e.g. warping the spectral envelope with the help of a psychoacoustical characteristic or simply by summing up adjacent frequency bands within the encoder before applying the distribution quantization. After reconstruction of the spectral envelope from the splitting point indices and the total mass on decoder side, the envelope has to be dewarped by the inverse characteristic.

Some further embodiments provide adaptive envelope conversion: As mentioned earlier, there is no need to apply the distribution quantization on the energies of the spectral envelope (i.e., abs(x)2 of a signal x), but every other (positive, real-valued) representation is realizable (e.g. abs (x), sqrt(abs(x)), etc.). To be able to exploit the different shape fitting properties of various envelope representations, it is reasonable to use an adaptive conversion technique. Therefore, a detection of the best matching conversion (of a fixed, predefined set) for the current envelope is performed as a preprocessing step, before the distribution quantization is applied. The used conversion has to be signaled and transmitted via the bitstream, to enable a correct reconversion on decoder side.

Further embodiments are configured to support an adaptive number of blocks: To obtain an even higher flexibility of the proposed model, it is beneficial to be able to switch between different numbers of blocks for each spectral envelope. The currently chosen number of blocks can be either of a predefined set to minimize the bit demand for signaling or transmitted explicitly to allow for highest flexibility. On the one hand, this reduces the overall bitrate, as for steady envelope shapes there is no need for high adaptivity. On the other hand, smaller numbers of blocks lead to bigger block masses, which allow for a more precise fitting of strong single peaks with steep slopes.

Some embodiments are configured to provide envelope stabilization. Due to a higher flexibility of the proposed distribution quantization model compared to e.g. a scale-factor band based approach, fluctuations between temporal adjacent envelopes can lead to unwanted instabilities. To counteract this effect, a signal-adaptive envelope stabilization technique is applied as a postprocessing step: For steady signal parts, where only few fluctuations are to be expected, the envelope is stabilized by a smoothing of temporally neighboring envelope values. For signal parts that naturally involve strong temporal changes, like e.g. transients or sibilant/fricative on-/offsets, no or only weak smoothing is applied.

In the following, an algorithm realizing envelope distribution quantization and coding according to an embodiment is described.

Description of the practical realization of the proposed distribution quantization method for coding the spectral envelope in an SBR-like scenario. The following depiction of the algorithm refers to the encoder and decoder side steps that may, e.g., be conducted to process one specific envelope:

In the following, a corresponding encoder is described.

Envelope determination and preprocessing may, for example, be conducted as follows:

- Determination of a spectral energy target envelope curve (e.g. represented by 20 sub-band samples) and its corresponding total energy.
- Application of envelope warping by pairwise averaging sub band values to reduce the total number of values (e.g. averaging of upper 8 sub band values and thus reduce total number from 20 to 16).
- Application of envelope magnitude conversion for a better match between envelope model performance and perceptual quality criteria (e.g. extraction of the 4th root for every sub band value, $$\hat{x}_k = \sqrt[4]{x_k}).$$

Distribution quantization and coding may, for example, be conducted as follows:

- Multiple determination of sub band indices splitting the envelope in a predefined number blocks of equal mass (e.g. 4 times repetition of determination for splitting envelope into 3, 4, 6, and 8 blocks).
- Full reconstruction of distribution quantized envelopes ("analysis by synthesis" approach, see below).
- Determination and decision on number of blocks resulting in the most precise description of the envelope (e.g. by comparing the cross-correlations of distribution quantized envelopes and original).
- Loudness correction by comparison of original and distribution quantized envelope and according adaptation of total energy.
- Coding of split indices using the same algorithm as in TSD-tool (see Kuntz, A., Disch, S., Bäckström, T., and Robilliard, J. "The Transient Steering Decorrelator Tool in the Upcoming MPEG Unified Speech and Audio Coding Standard". In *Audio Engineering Society Convention* 131, October 2011).
- Signaling of number of blocks used for distribution quantization (e.g. 4 predefined numbers of blocks, signaling via 2 bits).
- Quantization and coding of total energy (e.g. using Huffmann coding).

Now, a corresponding decoder is described.

Decoding and inverse quantization may, for example, be conducted as follows:

- Decoding of number of blocks to be used for distribution quantization and decoding of total energy.
- Decoding of split indices using the same algorithm as in TSD-tool (see Kuntz, A., Disch, S., Bäckström, T., and Robilliard, J. "The Transient Steering Decorrelator Tool in the Upcoming MPEG Unified Speech and Audio Coding Standard". In *Audio Engineering Society Convention* 131, October 2011).
- Approximation of smooth cumulative mass curve via spline interpolation.
- Reconstruction of spectral envelope from cumulative domain via 1st derivative (e.g. by taking the difference of consecutive samples).

Postprocessing may, for example, be conducted as follows:

- Application of envelope stabilization to counteract fluctuations between subsequent envelopes caused by quantization errors (e.g. via temporal smoothing of reconstructed sub band values, $\hat{x}_{curr,k}=(1-\alpha)\cdot x_{curr,k}+\alpha\cdot x_{prev,k}$, with $\alpha=0.1$ for frames containing transient signal portions and $\alpha=0.25$ otherwise).
- Reversion of envelope conversion according to application in encoder.
- Reversion of envelope warping according to application in encoder.

In the following, efficient encoding and decoding of splitting points is described. The splitting points encoder 225 of FIG. 4 and FIG. 5 may, e.g., be configured to implement the efficient encoding as described below. The splitting points decoder 105 of FIG. 2 may, e.g., be configured to implement the efficient decoding as described below.

In the embodiment illustrated by FIG. 2, the apparatus for decoding further comprises the splitting points decoder 105 for decoding one or more encoded points according to a decoding rule to obtain the one or more splitting points. The splitting points decoder 105 is configured to analyse a total positions number indicating a total number of possible splitting point positions, a splitting points number indicating a number of splitting points, and a splitting points state number. Moreover, the splitting points decoder 105 is configured to generate an indication of one or more positions of splitting points using the total positions number, the splitting points number and the splitting points state number. In a particular embodiment, the splitting points decoder 105 may, e.g., be configured to generate an indication of two or more positions of splitting points using the total positions number, the splitting points number and the splitting points state number.

In the embodiments illustrated by FIG. 4 and FIG. 5, the apparatus further comprises a splitting points encoder 225 for encoding a position of each of the one or more splitting points to obtain one or more encoded points. The splitting points encoder 225 is configured to encode a position of each of the one or more splitting points by encoding a splitting points state number. Moreover, the splitting points encoder 225 is configured to provide a total positions number indicating a total number of possible splitting point positions, and a splitting points number indicating the number of the one or more splitting points. The splitting points state number, the total positions number and the splitting points number together indicate the position of each of the one or more splitting points.

Figure 15:
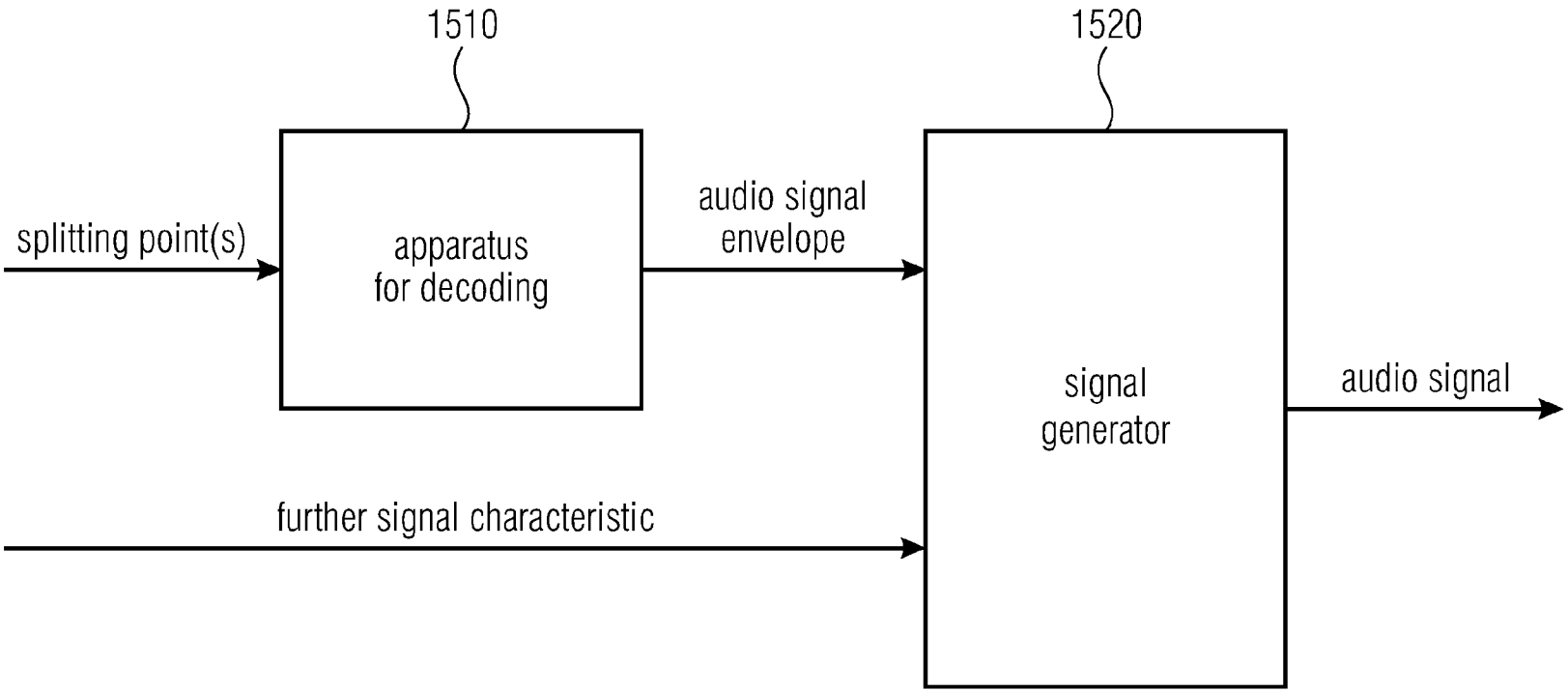
FIG. 15 an apparatus for reconstructing an audio signal according to an embodiment.

FIG. 15 an apparatus for reconstructing an audio signal according to an embodiment. The apparatus comprises an apparatus for decoding 1510 according to one of the above-described embodiments or according to the embodiments described below to obtain a reconstructed audio signal envelope of the audio signal, and a signal generator 1520 for generating the audio signal depending on the audio signal envelope of the audio signal and depending on a further signal characteristic of the audio signal, the further signal characteristic being different from the audio signal envelope. As already outlined above, a person skilled in the art is aware that from a signal envelope of an audio signal and from a further signal characteristic of the audio signal, the audio signal itself can be reconstructed. For example, the signal envelope may, e.g., indicate the energy of the samples of the audio signal. The further signal characteristic may, for example, indicate for each sample of, for example, a time-domain audio signal, whether the sample has a positive or negative value.

Some particular embodiments are based on that a total positions number indicating the total number of possible splitting points positions and a splitting points number indicating the total number of splitting points may be available in a decoding apparatus of the present invention. For example, an encoder may transmit the total positions number and/or the splitting points number to the apparatus for decoding.

Based on these assumptions, some embodiments implement the following concepts:

Let N be the (total) number of possible splitting points positions, and let P be the (total) number of splitting points.

It is assumed that both the apparatus for encoding as well as the apparatus for decoding are aware of the values of N and P.

Knowing N and P, it can be derived that there are only $$\binom{N}{P}$$

different combinations of possible splitting point positions.

For example, if the positions of possible splitting points positions are numbered from 0 to N−1 and if P=8, then a first possible combination of splitting point positions with events would be (0, 1, 2, 3, 4, 5, 6, 7), a second one would be (0, 1, 2, 3, 4, 5, 6, 8), and so on, up to the combination (N−8, N−7, N−6, N−5, N−4, N−3, N−2, N−1), so that in total there are $$\binom{N}{P}$$

different combinations.

The further finding is employed, that a splitting points state number may be encoded by an apparatus for encoding and that the splitting points state number is transmitted to the decoder. If each of the possible $$\binom{N}{P}$$

combinations is represented by a unique splitting points state number and if the apparatus for decoding is aware which splitting points state number represents which combination of splitting points positions, then the apparatus for decoding can decode the positions of the splitting points using N, P and the splitting points state number. For a lot of typical values for N and P, such a coding technique employs fewer bits for encoding splitting point positions of events compared to other concepts.

Stated differently, the problem of encoding the splitting point positions can be solved by encoding a discrete number P of positions pk on a range of [0 . . . N−1], such that the positions are not overlapping pk≠ph for k≠h, with as few bits as possible. Since the ordering of positions does not matter, it follows that the number of unique combinations of positions is the binominal coefficient $$\binom{N}{P}.$$

The number of necessitated bits is thus $$\text{bits} = ceil\left(\log_2\left(\binom{N}{P}\right)\right)$$

Some embodiments employ a position by position decoding concept. A position-by-position decoding concept. This concept is based on the following findings:

Assume that N is the (total) number of possible splitting point positions and P is the number of splitting points (this means that N may be the total positions number FSN and P may be the splitting points number ESON). The first possible splitting point position is considered. Two cases may be distinguished.

If the first possible splitting point position is a position which does not comprise a splitting point, then, with respect to the remaining N−1 possible splitting point positions, there are only $$\binom{N-1}{P}$$

different possible combinations of the P splitting points with respect to the remaining N−1 possible splitting point positions.

However, if the possible splitting point position is a position comprising a splitting point, then, with respect to the remaining N−1 possible splitting point positions, there are only $$\binom{N-1}{P-1}=\binom{N}{P}-\binom{N-1}{P}$$

different possible combinations of the remaining P−1 possible splitting point positions with respect to the remaining N−1 splitting points.

Based on this finding, embodiments are further based on the finding that all combinations with a first possible splitting point position where no splitting point is located, should be encoded by splitting points state numbers that are smaller than or equal to a threshold value. Furthermore, all combinations with a first possible splitting point position where a splitting point is not located, should be encoded by splitting points state numbers that are greater than a threshold value. In an embodiment, all splitting points state numbers may be positive integers or 0 and a suitable threshold value regarding the first possible splitting point position may be $$\binom{N-1}{P}.$$

In an embodiment, it is determined, whether the first possible splitting point position of a frame comprises a splitting point by testing, whether the splitting points state number is greater than a threshold value. (Alternatively, the encoding/decoding process of embodiments may also be realized, by testing whether the splitting points state number is greater than or equal to, smaller than or equal to, or smaller than a threshold value.)

After analysing the first possible splitting point position, decoding is continued for the second possible splitting point position using adjusted values: Besides adjusting the number of considered splitting point positions (which is reduced by one), the splitting points number is also reduced by one and the splitting points state number is adjusted, in case the splitting points state number was greater than the threshold value, to delete the portion relating to the first possible splitting point position from the splitting points state number. The decoding process may be continued for further possible splitting point positions in a similar manner.

In an embodiment, a discrete number P of positions pk on a range of [0 . . . N−1] is encoded, such that the positions are not overlapping pk≠ph for k≠h. Here, each unique combination of positions on the given range is called a state and each possible position in that range is called a possible splitting point position (pspp). According to an embodiment of an apparatus for decoding, the first possible splitting point position in the range is considered. If the possible splitting point position does not have a splitting point, then the range can be reduced to N−1, and the number of possible states reduces to $$\binom{N-1}{P}.$$

Conversely, if the state is larger than $$\binom{N-1}{P},$$

then it can be concluded that at the first possible splitting point position, a splitting point is located. The following decoding algorithm may result from this:

```
For each pspp h
    If state > (N − h − 1 choose P) then
        Assign a splitting point to pspp h
        Update remaining state state := state − (N − h − 1 choose P)
        Reduce number of positions left P := P − 1
    End
End
```

Calculation of the binomial coefficient on each iteration would be costly. Therefore, according to embodiments, the following rules may be used to update the binomial coefficient using the value from the previous iteration:

$$\binom{N}{P}=\binom{N-1}{P}\cdot\frac{N}{N-P}$$

and $$\binom{N}{P}=\binom{N}{P-1}\cdot\frac{N-P+1}{P}$$

Using these formulas, each update of the binomial coefficient costs only one multiplication and one division, whereas explicit evaluation would cost P multiplications and divisions on each iteration.

In this embodiment, the total complexity of the decoder is P multiplications and divisions for initialization of the binomial coefficient, for each iteration 1 multiplication, division and if-statement, and for each coded position 1 multiplication, addition and division. Note that in theory, it would be possible to reduce the number of divisions needed for initialization to one. In practice, however, this approach would result in very large integers, which are difficult to handle. The worst case complexity of the decoder is then N+2P divisions and N+2P multiplications, P additions (can be ignored if MAC-operations are used), and N if-statements.

In an embodiment, the encoding algorithm employed by an apparatus for encoding does not have to iterate through all possible splitting point positions, but only those that have a position assigned to them. Therefore, $$\text{For each position } p_h,$$

$$h = 1 \ldots P$$

$$\text{Update state state} := \text{state} + \binom{p_h - 1}{h}$$

The encoder worst case complexity is P(P−1) multiplications and P(P−1) divisions, as well as P−1 additions.

Figure 9:
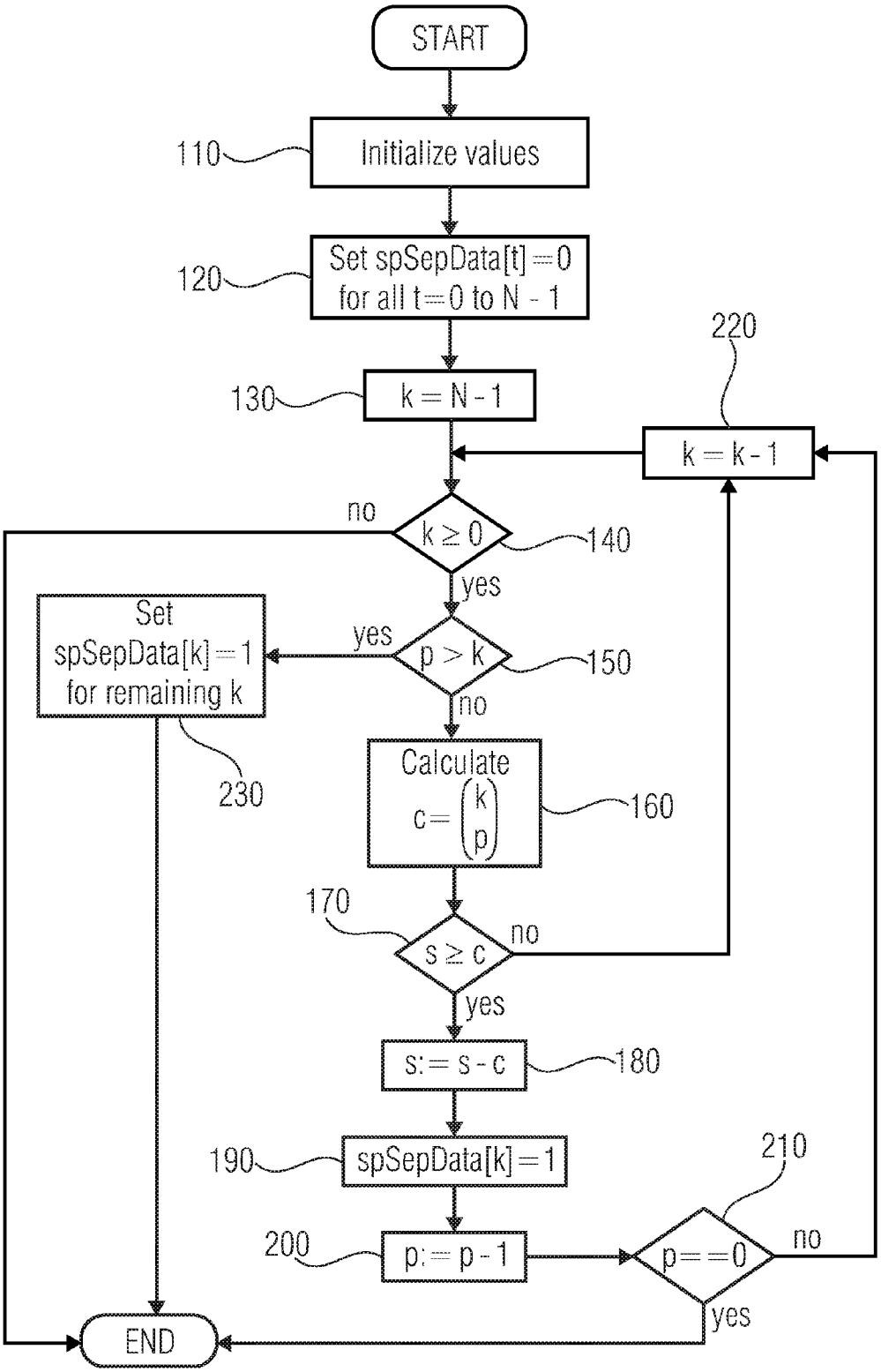
FIG. 9 illustrates a decoding process for decoding splitting point positions according to an embodiment.

FIG. 9 illustrates a decoding process according to an embodiment of the present invention. In this embodiment, decoding is performed on a position-by-position basis.

In step 110, values are initialized. The apparatus for decoding stores the splitting points state number, which it received as an input value, in variable s. Furthermore, the (total) number of splitting points as indicated by a splitting points number is stored in variable p. Moreover the total number of possible splitting point positions contained in the frame as indicated by a total positions number is stored in variable N.

In step 120, the value of spSepData[t] is initialized with 0 for all possible splitting point positions. The bit array spSepData is the output data to be generated. It indicates for each possible splitting point position t, whether the possible splitting point position comprises a splitting point (spSepData[t]=1) or whether it does not (spSepData[t]=0). In step 120, the corresponding values of all possible splitting point positions are initialized with 0.

In step 130, variable k is initialized with the value N−1. In this embodiment, the N possible splitting point positions are numbered 0, 1, 2, . . . , N−1. Setting k=N−1 means that the possible splitting point position with the highest number is regarded first.

In step 140, it is considered whether k≥0. If k<0, the decoding of the splitting point positions has been finished and the process terminates, otherwise the process continues with step 150.

In step 150, it is tested whether p>k. If p is greater than k, this means that all remaining possible splitting point positions comprise a splitting point. The process continues at step 230 wherein all spSepData field values of the remaining possible splitting point positions 0, 1, . . . , k are set to 1 indicating that each of the remaining possible splitting point positions comprise a splitting point. In this case, the process terminates afterwards. However, if step 150 finds that p is not greater than k, the decoding process continues in step 160.

In step 160, the value $$c = \binom{k}{p}$$

is calculated. c is used as threshold value.

In step 170, it is tested, whether the actual value of the splitting points state number s is greater than or equal to c, wherein c is the threshold value just calculated in step 160.

If s is smaller than c, this means that the considered possible splitting point position (with splitting point k) does not comprise a splitting point. In this case, no further action has to be taken, as spSepData[k] has already been set to 0 for this possible splitting point position in step 140. The process then continues with step 220. In step 220, k is set to be k:=k−1 and the next possible splitting point position is regarded.

However, if the test in step 170 shows that s is greater than or equal to c, this means that the considered possible splitting point position k comprises a splitting point. In this case, the splitting points state number s is updated and is set to the value s:=s−c in step 180. Furthermore, spSepData[k] is set to 1 in step 190 to indicate that the possible splitting point position k comprises a splitting point. Moreover, in step 200, p is set to p−1, indicating that the remaining possible splitting point position to be examined now only comprise p−1 possible splitting point positions with splitting points.

In step 210, it is tested whether p is equal to 0. If p is equal to 0, the remaining possible splitting point positions do not comprise splitting points and the decoding process finishes.

Otherwise, at least one of the remaining possible splitting point positions comprises an event and the process continues in step 220 where the decoding process continues with the next possible splitting point position (k−1).

The decoding process of the embodiment illustrated in FIG. 9 generates the array spSepData as output value indicating for each possible splitting point position k, whether the possible splitting point position comprises a splitting point (spSepData[k]=1) or whether it doesn't (spSepData[k]=0).

FIG. 10 illustrates a pseudo code implementing the decoding of splitting point positions according to an embodiment.

Figure 11:
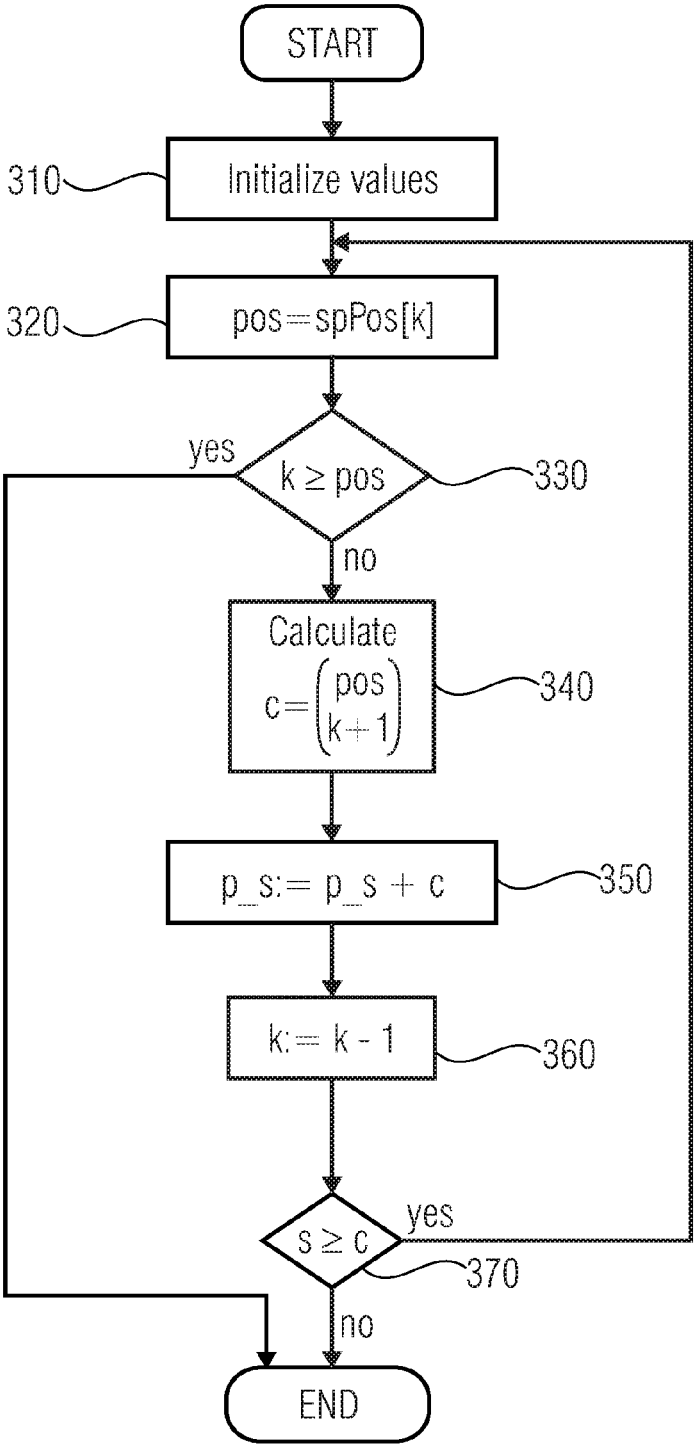
FIG. 11 illustrates an encoding process for encoding splitting points according to an embodiment.

FIG. 11 illustrates an encoding process for encoding splitting points according to an embodiment. In this embodiment, encoding is performed on a position-by-position basis. The purpose of the encoding process according to the embodiment illustrated in FIG. 11 is to generate a splitting points state number.

In step 310, values are initialized. p_s is initialized with 0. The splitting points state number is generated by successively updating variable p_s. When the encoding process is finished, p_s will carry the splitting points state number. Step 310 also initializes variable k by setting k to k:=number splitting points−1.

In step 320, variable "pos" is set to pos:=spPos[k], wherein spPos is an array holding the positions of possible splitting point positions which comprise splitting points.

The splitting point positions in the array are stored in ascending order.

In step 330, a test is conducted, testing whether k≥pos. If this is the case, the process terminates. Otherwise, the process is continued in step 340.

In step 340, the value $$c = \binom{pos}{k+1}$$

is calculated.

In step 350, variable p_s is updated and set to p_s:=p_s+c.

In step 360, k is set to k:=k−1.

Then, in step 370, a test is conducted, testing whether k≥0. In this case, the next possible splitting point position k−1 is regarded. Otherwise, the process terminates.

Figures 12, 13:
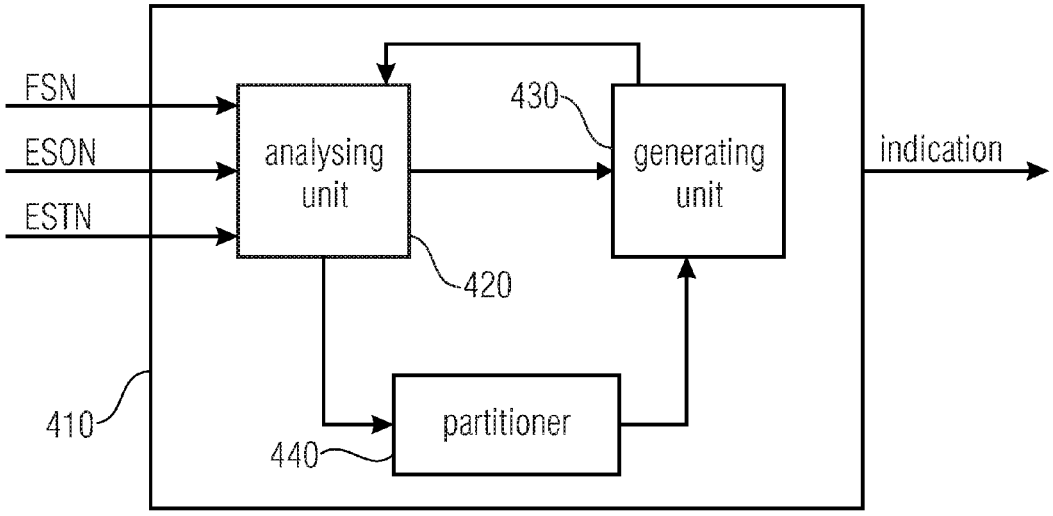
FIG. 12 depicts pseudo code, implementing the encoding of splitting point positions according to an embodiment of the present invention.
FIG. 13 illustrates a splitting points decoder according to an embodiment.

FIG. 12 depicts pseudo code, implementing the encoding of splitting point positions according to an embodiment of the present invention.

FIG. 13 illustrates a splitting points decoder 410 according to an embodiment.

A total positions number FSN, indicating the total number of possible splitting point positions, a splitting points number ESON indicating the (total) number of splitting points, and an splitting points state number ESTN are fed into the splitting points decoder 410. The splitting points decoder 410 comprises a partitioner 440. The partitioner 440 is adapted to split the frame into a first partition comprising a first set of possible splitting point positions and into a second partition comprising a second set of possible splitting point positions, and wherein the possible splitting point positions which comprise splitting points are determined separately for each of the partitions. By this, the positions of the splitting points may be determined by repeatedly splitting partitions in even smaller partitions.

The "partition based" decoding of the splitting points decoder 410 of this embodiment is based on the following concepts:

Partition based decoding is based on the idea that a set of all possible splitting point positions is split into two partitions A and B, each partition comprising a set of possible splitting point positions, wherein partition A comprises $N_a$ possible splitting point positions and wherein partition B comprises $N_b$ possible splitting point positions, and such that $N_a+N_b=N$. The set of all possible splitting point positions can be arbitrarily split into two partitions, such that partition A and B have nearly the same total number of possible splitting point positions (e.g., such that $N_a=N_b$ or $N_a=N_b-1$). By splitting the set of all possible splitting point positions into two partitions, the task of determining the actual splitting point positions is also split into two subtasks, namely determining the actual splitting point positions in frame partition A and determining the actual splitting point positions in frame partition B.

In this embodiment, it is again assumed that the splitting points decoder 105 is aware of the total number of possible splitting point positions, the total number of splitting points and a splitting points state number. To solve both subtasks, the splitting points decoder 105 should also be aware of the number of possible splitting point positions of each partition, the number of splitting points in each partition and the splitting points state number of each partition (such a splitting points state number of a partition is now referred to as "splitting points substate number").

As the splitting points decoder itself splits the set of all possible splitting points into two partitions, it per se knows that partition A comprises $N_a$ possible splitting point positions and that partition B comprises $N_b$ possible splitting point positions. Determining the number of actual splitting points for each one of both partitions is based on the following findings.

As the set of all possible splitting point positions has been split into two partitions, each of the actual splitting point positions is now located either in partition A or in partition B. Furthermore, assuming that P is the number of splitting points of a partition, and N is the total number of possible splitting point positions of the partition and that f(P,N) is a function that returns the number of different combinations of splitting point positions, then the number of different combinations of the splitting of the whole set of possible splitting point positions (which has been split into partition A and partition B) is:

| Number of splitting points in partition A | Number of splitting points in partition B | Number of different combinations in the whole set of splitting point positions with this configuration |
|---|---|---|
| 0 | P | $f(0, N_a) \cdot f(P, N_b)$ |
| 1 | P-1 | $f(1, N_a) \cdot f(P-1, N_b)$ |
| 2 | P-2 | $f(2, N_a) \cdot f(P-2, N_b)$ |
| . . . | . . . | . . . |
| P | 0 | $f(P, N_a) \cdot f(0, N_b)$ |

Based on the above considerations, according to an embodiment all combinations with the first configuration, where partition A has 0 splitting points and where partition B has P splitting points, should be encoded with an splitting points state number smaller than a first threshold value. The splitting points state number may be encoded as an integer value being positive or 0. As there are only $f(0,N_a)\cdot f(P,N_b)$ combinations with the first configuration, a suitable first threshold value may be $f(0,N_a)\cdot f(P,N_b)$.

All combinations with the second configuration, where partition A has 1 splitting points and where partition B has P−1 splitting points, should be encoded with a splitting points state number greater than or equal to the first threshold value, but smaller than or equal to a second threshold value. As there are only $f(1,N_a)\cdot f(P-1,N_b)$ combinations with the second configuration, a suitable second value may be $f(0,N_a)\cdot f(P,N_b)+f(1,N_a)\cdot f(P-1,N_b)$. The splitting points state number for combinations with other configurations is determined similarly.

According to an embodiment, decoding is performed by separating a set of all possible splitting point positions into two partitions A and B. Then, it is tested whether a splitting points state number is smaller than a first threshold value. In an embodiment, the first threshold value may be $f(0,N_a)\cdot f(P,N_b)$.

If the splitting points state number is smaller than the first threshold value, it can then be concluded that partition A comprises 0 splitting points and partition B comprises all P splitting points. Decoding is then conducted for both partitions with the respectively determined number representing the number of splitting points of the corresponding partition. Furthermore a first splitting points state number is determined for partition A and a second splitting points state number is determined for partition B which are respectively used as new splitting points state number. Within this document, a splitting points state number of a partition is referred to as a "splitting points substate number".

However, if the splitting points state number is greater than or equal to the first threshold value, the splitting points state number may be updated. In an embodiment, the splitting points state number may be updated by subtracting a value from the splitting points state number, by subtracting the first threshold value, e.g. $f(0,N_a)\cdot f(P,N_b)$. In a next step, it is tested, whether the updated splitting points state number is smaller than a second threshold value. In an embodiment, the second threshold value may be $f(1,N_a)\cdot f(P-1,N_b)$. If splitting points state number is smaller than the second threshold value, it can be derived that partition A has one splitting point and partition B has P−1 splitting points.

Decoding is then conducted for both partitions with the respectively determined numbers of splitting points of each partition. A first splitting points substate number is employed for the decoding of partition A and a second splitting points substate number is employed for the decoding of partition B. However, if the splitting points state number is greater than or equal to the second threshold value, the splitting points state number may be updated. In an embodiment, the splitting points state number may be updated by subtracting a value from the splitting points state number, $f(1,N_a)\cdot f(P-1,N_b)$. The decoding process is similarly applied for the remaining distribution possibilities of the splitting points regarding the two partitions.

In an embodiment, a splitting points substate number for partition A and a splitting points substate number for partition B may be employed for decoding of partition A and partition B, wherein both event substate number are determined by conducting the division:

splitting points state number/f(number of splitting points of partition B,$N_b$)

Advantageously, the splitting points substate number of partition A is the integer part of the above division and the splitting points substate number of partition B is the reminder of that division. The splitting points state number employed in this division may be the original splitting points state number of the frame or an updated splitting points state number, e.g. updated by subtracting one or more threshold values, as described above.

To illustrate the above described concept of partition based decoding, a situation is considered where a set of all possible splitting point positions has two splitting points. Furthermore, if f(p,N) is again the function that returns the number of different combinations of splitting point positions of a partition, wherein p is the number of splitting points of a frame partition and N is the total number of splitting points of that partition. Then, for each of the possible distributions of the positions, the following number of possible combinations results:

| Positions in partition A | Position in partition B | Number of combinations in this configuration |
|---|---|---|
| 0 | 2 | $f(0, N_a) \cdot f(2, N_b)$ |
| 1 | 1 | $f(1, N_a) \cdot f(1, N_b)$ |
| 2 | 0 | $f(2, N_a) \cdot f(0, N_b)$ |

It can thus be concluded that if the encoded splitting points state number of the frame is smaller than $f(0,N_a)\cdot f(2,N_b)$, then the positions of the splitting points have to be distributed as 0 and 2. Otherwise, $f(0,N_a)\cdot f(2,N_b)$ is subtracted from the splitting points state number and the result is compared with $f(1,N_a)\cdot f(1,N_b)$. If it is smaller, then positions are distributed as 1 and 1. Otherwise, we have only the distribution 2 and 0 left, and the positions are distributed as 2 and 0.

In the following, a pseudo code is provided according to an embodiment for decoding positions of splitting points (here: "sp"). In this pseudo code, "sp_a" is the (assumed) number of splitting points in partition A and "sp_b" is the (assumed) number of splitting points in partition B. In this pseudo code, the (e.g., updated) splitting points state number is referred to as "state". The splitting points substate numbers of partitions A and B are still jointly encoded in the "state" variable. According to a joint coding scheme of an embodiment, the splitting points substate number of A (herein referred to as "state_a") is the integer part of the division state/f(sp_b, $N_b$) and the spitting points substate number of B (herein referred to as "state_b") is the reminder of that division. By this, the length (total number of splitting points of the partition) and the number of encoded positions (number of splitting points in the partition) of both partitions can be decoded by the same approach:

```
Function x = decodestate(state, sp, N)

1.  Split vector into two partitions of length Na and Nb.
2.  For sp__a from 0 to sp
        a.  sp__b = sp − sp__a
        b.  if state < f(sp__a,Na)*f(sp__b,Nb) then
            break for-loop.
        c.  state := state − f(sp__a,Na)*f(sp__b,Nb)
3.  Number of possible states for partition B is
    no__states__b = f(sp__b,Nb)
4.  The states, state__a and state__b, of partitions A and
    B, respectively, are the integer part and the
    reminder of the division state/no__states__b.
5.  If Na > 1 then the decoded vector of partition A is
    obtained recursively by
        xa = decodestate(state__a,sp__a,Na)
    Otherwise (Na==1), and the vector xa is a scalar
    and we can set xa=state__a.
6.  If Nb > 1 then the decoded vector of partition B is
    obtained recursively by
        xb = decodestate(state__b,sp__b,Nb)
    Otherwise (Nb==1), and the vector xb is a scalar and
    we can set xb=state__b.
7.  The final output x is obtained by merging xa and xb
    by x = [xa xb].
```

The output of this algorithm is a vector that has a one (1) at every encoded position (i.e. a splitting point position) and zero (0) elsewhere (i.e. at possible splitting point positions which do not comprise splitting points).

In the following, a pseudo code is provided according to an embodiment for encoding splitting point positions which uses similar variable names with a similar meaning as above:

```
Function state = encodestate(x,N)

1.  Split vector into two partitions xa and xb of length
    Na and Nb.
2.  Count splitting points in partitions A and B in sp__a
    and sp__b, and set sp=sp__a+sp__b.
3.  Set state to 0
4.  For k from 0 to sp__a−1
    a.          state := state + f(k,Na)*f(sp-k,Nb)
5.  If Na > 1, encode partition A by
                state__a = encodestate(xa, Na);
    Otherwise (Na==1), set state__a = xa.
6.  If Nb > 1, encode partition B by
                state__b = encodestate(xb,Nb);
    Otherwise (Nb==1), set state__b = xb.
7.  Encode states jointly
    state := state + state__a*f(sp__b,Nb) + state__b.
```

Here, it is assumed that, similarly to the decoder algorithm, every encoded position (i.e., a splitting point position) is identified by a one (1) in vector x and all other elements are zero (0) (e.g., possible splitting point positions which do not comprise a splitting point).

The above recursive methods formulated in pseudo code can readily be implemented in a non-recursive way using standard methods.

According to an embodiment, function f(p,N) may be realized as a look-up table. When the positions are non-overlapping, such as in the current context, then the number-of-states function f(p,N) is simply the binomial function which can be calculated on-line. There is $$f(p, N) = \frac{N(N-1)(N-2)\ \dots\ (N-k)}{k(k-1)(k-2)\ \dots\ 1}.$$

According to an embodiment of the present invention, both the encoder and the decoder have a for-loop where the product $f(p-k,N_a)*f(k,N_b)$ is calculated for consecutive values of k. For efficient computation, this can be written as $$\begin{aligned} f(p-k, N_a)f(k, N_b) &= \frac{N_a(N_a-1)(N_a-2)\ \dots\ (N_a-p+k)}{(p-k)(p-k-1)(p-k-2)\ \dots\ 1} \cdot \\ &\quad \frac{N_b(N_b-1)(N_b-2)\ \dots\ (N_b-k)}{k(k-1)(k-2)\ \dots\ 1} \\ &= \frac{N_a(N_a-1)(N_a-2)\ \dots\ (N_a-p-k+1)}{(p-k+1)(p-k)(p-k-1)\ \dots\ 1} \cdot \\ &\quad \frac{N_b(N_b-1)(N_b-2)\ \dots\ (N_b-k+1)}{(k-1)(k-2)\ \dots\ 1} \cdot \\ &\quad \frac{p-k+1}{N_a-p-k+1} \cdot \frac{N_a-k}{k} \\ &= f(p-k+1, N_a)f(k-1, N_b) \cdot \\ &\quad \frac{p-k+1}{N_a-p-k+1} \cdot \frac{N_a-k}{k}. \end{aligned}$$

In other words, successive terms for subtraction/addition (in step 2*b* and 2*c* in the decoder, and in step 4*a* in the encoder) can be calculated by three multiplications and one division per iteration.

Returning to FIG. 1, alternative embodiments implement the apparatus of FIG. 1 for decoding to obtain a reconstructed audio signal envelope in a different way. In such embodiments, as already explained before, the apparatus comprises a signal envelope reconstructor 110 for generating the reconstructed audio signal envelope depending on one or more splitting points, and an output interface 120 for outputting the reconstructed audio signal envelope.

Again, the signal envelope reconstructor 110 is configured to generate the reconstructed audio signal envelope such that the one or more splitting points divide the reconstructed audio signal envelope into two or more audio signal envelope portions, wherein a predefined assignment rule defines a signal envelope portion value for each signal envelope portion of the two or more signal envelope portions depending on said signal envelope portion.

In such alternative embodiments, however, a predefined envelope portion value is assigned to each of the two or more signal envelope portions.

In such embodiments, the signal envelope reconstructor 110 is configured to generate the reconstructed audio signal envelope such that, for each signal envelope portion of the two or more signal envelope portions, an absolute value of the signal envelope portion value of said signal envelope portion is greater than 90% of an absolute value of the predefined envelope portion value being assigned to said signal envelope portion, and such that the absolute value of the signal envelope portion value of said signal envelope portion is smaller than 110% of the absolute value of the predefined envelope portion value being assigned to said signal envelope portion. This allows some kind of deviation from the predefined envelope portion value.

In a particular embodiment, however, the signal envelope reconstructor 110 is configured to generate the reconstructed audio signal envelope such that, the signal envelope portion value of each of the two or more signal envelope portions is equal to the predefined envelope portion value being assigned to said signal envelope portion.

For example, three splitting points may be received which divide the audio signal envelope into four audio signal envelope portions. An assignment rule may specify, that the predefined envelope portion value of the first signal envelope portion is 0.15, that the predefined envelope portion value of the second signal envelope portion is 0.25, that the predefined envelope portion value of the third signal envelope portion is 0.25, and that that the predefined envelope portion value of the first signal envelope portion is 0.35. When receiving the three spitting points, the signal envelope reconstructor 110 then reconstructs the signal envelope accordingly according to the concepts described above.

In another embodiment, one splitting point may be received which divides the audio signal envelope into two audio signal envelope portions. An assignment rule may specify, that the predefined envelope portion value of the first signal envelope portion is p, that the predefined envelope portion value of the second signal envelope portion is 1−p. For example, if p=0.4 then 1−p=0.6. Again, when receiving the three spitting points, the signal envelope reconstructor 110 then reconstructs the signal envelope accordingly according to the concepts described above.

Such alternative embodiments which employ predefined envelope portion values may employ each of the concepts described before.

In an embodiment, the predefined envelope portion values of two or more of the signal envelope portions differ from each other.

In another embodiment, the predefined envelope portion value of each of the signal envelope portions differs from the predefined envelope portion value of each of the other signal envelope portions.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An apparatus for generating an audio signal envelope of an audio signal from at least one coding value, comprising:

an input interface for receiving the at least one coding value, and an envelope generator for generating the audio signal envelope depending on the at least one coding value, wherein the envelope generator is configured to generate an aggregation function depending on the at least one coding value, wherein the aggregation function comprises a plurality of aggregation points, wherein each of the aggregation points comprises an argument value and an aggregation value, wherein the aggregation function monotonically increases, and wherein each of the at least one coding value indicates at least one of the argument value and the aggregation value of one of the aggregation points of the aggregation function, wherein the envelope generator is configured to generate the audio signal envelope such that the audio signal envelope comprises a plurality of envelope points, wherein each of the envelope points comprises an argument value and an envelope value, and wherein, for each of the aggregation points of the aggregation function, one of the envelope points of the audio signal envelope is assigned to said aggregation point such that the argument value of said envelope point is equal to the argument value of said aggregation point, wherein the envelope generator is configured to generate the audio signal envelope such that the envelope value of each of the envelope points of the audio signal envelope depends on the aggregation value of at least one aggregation point of the aggregation function, and wherein the apparatus is implemented using a hardware apparatus or using a computer or using a combination of a hardware apparatus and a computer.

2. An apparatus according to claim 1, wherein the envelope generator is configured to determine the aggregation function by determining one of the aggregation points for each of the at least one coding value depending on said coding value, and by applying interpolation to acquire the aggregation function depending on the aggregation point of each of the at least one coding value.

3. An apparatus according to claim 1, wherein the envelope generator is configured to determine a first derivate of the aggregation function at a plurality of the aggregation points of the aggregation function.

4. An apparatus according to claim 1, wherein the envelope generator is configured to generate the aggregation function depending on the coding value so that the aggregation function comprises a continuous first derivative.

5. An apparatus according to claim 1, wherein the envelope generator is configured to determine the audio signal envelope by determining a ratio of a first difference and a second difference, said first difference being a difference between a first aggregation value of a first one of the aggregation points of the aggregation function and a second aggregation value of a second one of the aggregation points of the aggregation function, and said second difference being a difference between a first argument value of said first one of the aggregation points of the aggregation function and a second argument value of said second one of the aggregation points of the aggregation function.

6. An apparatus according to claim 5, wherein the envelope generator is configured to determine the audio signal envelope by applying $$\mathrm{tilt}(k) = \frac{c(k+1) - c(k-1)}{f(k+1) - f(k-1)}$$

wherein tilt(k) indicates a derivative of the aggregation function at the k-th coding value, wherein c(k+1) is said first aggregation value, wherein $f$(k+1) is said first argument value, wherein c(k−1) is said second aggregation value, wherein $f$(k−1) is said second argument value, wherein k is an integer indicating an index of one of the at least one coding value, wherein c(k+1)−c(k−1) is the first difference of the two aggregated values c(k+1) and c(k−1), and wherein $f$(k+1)−$f$(k−1) is the second difference of the two argument values $f$(k+1) and $f$(k−1).

7. An apparatus according to claim 5, wherein the envelope generator is configured to determine the audio signal envelope by applying $$tilt(k) = 0.5 \cdot \left( \frac{c(k+1) - c(k)}{f(k+1) - f(k)} + \frac{c(k) - c(k-1)}{f(k) - f(k-1)} \right)$$

wherein tilt(k) indicates a derivative of the aggregation function at the k-th coding value, wherein c(k+1) is said first aggregation value, wherein $f(k+1)$ is said first argument value, wherein c(k) is said second aggregation value, wherein $f(k)$ is said second argument value, wherein c(k−1) is a third aggregation value of a third one of the aggregation points of the aggregation function, wherein $f(k-1)$ is a third argument value of said third one of the aggregation points of the aggregation function, wherein k is an integer indicating an index of one of the at least one coding value, wherein c(k+1)−c(k) is the first difference of the two aggregated values c(k+1) and c(k), and wherein $f(k+1)-f(k)$ is the second difference of the two argument values $f(k+1)$ and $f(k)$.

8. An apparatus according to claim 1, wherein the input interface is configured to receive at least one splitting value as the at least one coding value, wherein the envelope generator is configured to generate the aggregation function depending on the at least one splitting value, wherein each of the at least one splitting value indicates the aggregation value of one of the aggregation points of the aggregation function, wherein the envelope generator is configured to generate the reconstructed audio signal envelope such that the at least one splitting points divide the reconstructed audio signal envelope into at least two audio signal envelope portions, wherein a predefined assignment rule defines a signal envelope portion value for each signal envelope portion of the at least two signal envelope portions depending on said signal envelope portion, and wherein the envelope generator is configured to generate the reconstructed audio signal envelope such that, for each of the at least two signal envelope portions, an absolute value of its signal envelope portion value is greater than half of an absolute value of the signal envelope portion value of each of the other signal envelope portions.

9. An apparatus for determining at least one coding value for encoding an audio signal envelope of an audio signal, comprising:

an aggregator for determining an aggregated value for each of a plurality of argument values, wherein the plurality of argument values are ordered such that a first argument value of the plurality of argument values either precedes or succeeds a second argument value of the plurality of argument values, when said second argument value is different from the first argument value, wherein an envelope value is assigned to each of the argument values, wherein the envelope value of each of the argument values depends on the audio signal envelope, and wherein the aggregator is configured to determine the aggregated value for each argument value of the plurality of argument values depending on the envelope value of said argument value, and depending on the envelope value of each of the plurality of argument values which precede said argument value, an encoding unit for determining at least one coding value depending on at least one of the aggregated values of the plurality of argument values, and wherein the apparatus is implemented using a hardware apparatus or using a computer or using a combination of a hardware apparatus and a computer.

10. An apparatus according to claim 9, wherein the aggregator is configured to determine the aggregated value for each argument value of the plurality of argument values by adding the envelope value of said argument value and the envelope value of the argument values which precede said argument value.

11. An apparatus according to claim 9, wherein the envelope value of each of the argument values indicates an n-th power of a spectral value of an audio signal envelope comprising the audio signal envelope as signal envelope, wherein n is an even integer greater zero.

12. An apparatus according to claim 9, wherein the envelope value of each of the argument values indicates an n-th power of an amplitude value of an audio signal envelope, being represented in a time domain, and comprising the audio signal envelope as signal envelope, wherein n is an even integer greater zero.

13. An apparatus according to claim 9, wherein the encoding unit is configured to determine the at least one coding value depending on at least one of the aggregated values of the argument values, and depending on a coding value number, which indicates how many values are to be determined by the encoding unit as the at least one coding value.

14. An apparatus according to claim 13, wherein the coding unit is configured to determine the at least one coding value according to $$c(k) = \min_j\left(\left|a(j) - k\frac{\max(a)}{N}\right|\right),$$

wherein c(k) indicates the k-th coding value to be determined by the coding unit, wherein j indicates the j-th argument value of the plurality of argument values, wherein a(j) indicates the aggregated value being assigned to the j-th argument value, wherein max(a) indicates a maximum value being one of the aggregated values which are assigned to one of the argument values, wherein none of the aggregated values which are assigned to one of the argument values is greater than the maximum value, and wherein $$\min_j\left(\left|a(j) - k\frac{\max(a)}{N}\right|\right)$$

indicates a minimum value being one of the argument values for which $$\left|a(j) - k\frac{\max(a)}{N}\right|$$

is minimal.

15. A method for generating an audio signal envelope of an audio signal from at least one coding value, comprising:

receiving the at least one coding value, and generating the audio signal envelope depending on the at least one coding value, wherein generating the audio signal envelope is conducted by generating an aggregation function depending on the at least one coding value, wherein the aggregation function comprises a plurality of aggregation points, wherein each of the aggregation points comprises an argument value and an aggregation value, wherein the aggregation function monotonically increases, and wherein each of the at least one coding value indicates at least one of the argument value and the aggregation value of one of the aggregation points of the aggregation function, wherein generating the audio signal envelope is conducted such that the audio signal envelope comprises a plurality of envelope points, wherein each of the envelope points comprises an argument value and an envelope value, and wherein, for each of the aggregation points of the aggregation function, one of the envelope points of the audio signal envelope is assigned to said aggregation point such that the argument value of said envelope point is equal to the argument value of said aggregation point, wherein generating the audio signal envelope is conducted such that the envelope value of each of the envelope points of the audio signal envelope depends on the aggregation value of at least one aggregation point of the aggregation function, and wherein the method is performed using a hardware apparatus or using a computer or using a combination of a hardware apparatus and a computer.

16. A non-transitory computer-readable medium comprising a computer program for implementing the method of claim 15 when being executed on a computer or signal processor.

17. A method for determining at least one coding value for encoding an audio signal envelope of an audio signal, comprising:

determining an aggregated value for each of a plurality of argument values, wherein the plurality of argument values are ordered such that a first argument value of the plurality of argument values either precedes or succeeds a second argument value of the plurality of argument values, when said second argument value is different from the first argument value, wherein an envelope value is assigned to each of the argument values, wherein the envelope value of each of the argument values depends on the audio signal envelope, and wherein the aggregator is configured to determine the aggregated value for each argument value of the plurality of argument values depending on the envelope value of said argument value, and depending on the envelope value of each of the plurality of argument values which precede said argument value, determining at least one coding value depending on at least one of the aggregated values of the plurality of argument values, and wherein the method is performed using a hardware apparatus or using a computer or using a combination of a hardware apparatus and a computer.

18. A non-transitory computer-readable medium comprising a computer program for implementing the method of claim 17 when being executed on a computer or signal processor.

* * * * *